US007559642B2

(12) United States Patent
Shigemura

(10) Patent No.: US 7,559,642 B2
(45) Date of Patent: Jul. 14, 2009

(54) SHEET MATERIAL CONVEYING APPARATUS AND IMAGE FORMING APPARATUS

(75) Inventor: Yoshihiro Shigemura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 506 days.

(21) Appl. No.: 11/275,053

(22) Filed: Dec. 6, 2005

(65) Prior Publication Data

US 2006/0119688 A1 Jun. 8, 2006

(30) Foreign Application Priority Data

Dec. 8, 2004 (JP) ..... 2004-355861
Dec. 9, 2004 (JP) ..... 2004-356217

(51) Int. Cl.
*B41J 2/01* (2006.01)

(52) U.S. Cl. ..... 347/104; 250/590; 271/186; 271/275; 347/55; 347/101; 347/217; 399/329

(58) Field of Classification Search ..... None
See application file for complete search history.

(56) References Cited

U.S. PATENT DOCUMENTS 6,309,064 B1 * 10/2001 Tanno et al. ..... 347/104
6,332,612 B1 * 12/2001 Kanemura ..... 271/275
6,508,540 B1 * 1/2003 Lean et al. ..... 347/55
2006/0066701 A1 * 3/2006 Hirakawa ..... 347/101

FOREIGN PATENT DOCUMENTS

| | | |
|---|---|---|
| JP | 3-48100 | 3/1991 |
| JP | 50-31828 | 2/1993 |
| JP | 2000-60168 | 9/2000 |
| JP | 2000-247476 | 9/2000 |

OTHER PUBLICATIONS

JP 2000-060168 A—Machine Translation, http://dossier.ipdl.inpit.go.jp/text_trans.html—Retrieved Oct. 30, 2008.*

* cited by examiner

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

A sheet material conveying apparatus for conveying a sheet material under attraction to a conveying belt has an attraction unit for attracting the sheet material to the conveying belt, and which exerts a attraction in succession from a front end to a rear end of the sheet material in a conveying direction thereof and from a position in the front end toward both ends in the direction of width, or in succession from an end at either side in the direction of width of the sheet material and a front end in the conveying direction thereof toward a rear end thereof, and from the either end toward an end at the other side.

5 Claims, 28 Drawing Sheets

SHEET MATERIAL CONVEYING APPARATUS AND IMAGE FORMING APPARATUS

BACKGROUND OF THE INVENTION

1. Field of the Invention

The present invention relates to a sheet conveying apparatus for conveying a sheet material by attraction to a conveyor belt, and an image forming apparatus equipped with such sheet conveying apparatus.

2. Related Background Art

An image forming apparatus such as a printer, a copying apparatus or a facsimile apparatus forms an image constituted of dot patterns, according to image information, on a sheet material (recording medium) such as paper or a plastic thin plate. Such image forming apparatus can be classified, according to recording methods, into an ink jet type, a wire dot type, a thermal type, a laser beam type and the like, and the apparatus of the ink jet type is so constructed as to form an image by discharging ink from a recording head onto a sheet material such as recording paper.

In the image forming apparatus, the sheet material has to be conveyed from a sheet feeding portion such as a cassette, through an image forming portion (recording portion) to a sheet discharge portion. The conveying operation of the sheet material after the sheet feeding is controlled at constant timings in the course of image formation until the sheet is discharged. Within such process, a particularly accurate conveying operation is required from the sheet feeding to the image formation, as the image forming position on the sheet material is affected. Also in the course of image formation, the conveying speed of the sheet material has to be constant, as otherwise an image magnification may be affected to result in an elongation or a contraction of the image. Particularly in case of a color image forming apparatus utilizing plural recording heads, images recorded in respective image forming portions are mutually displaced, and such displacement results in a color aberration in the color image forming apparatus, thus giving rise to an image defect. In order to avoid such drawback, it is necessary to accurately transmit a conveying force of precisely controlled conveying means to the sheet material.

In consideration of the foregoing situation, various conveying means have been proposed. For example, there is known a method of advancing a sheet material by a pair of rollers and limiting a conveying direction by a guide member. As the sheet material is advanced by a pressure between the rollers, this method has a strong conveying power and is therefore simple and secure. However, the paired rollers have to be positioned at an interval shorter than a smallest length of the sheet material to be used, and is unsuitable for conveying a sheet material of a size of a postcard or a name card. Also such method cannot be adopted in case a recorded surface has to be maintained in a non-contact state, as in a path from an image transfer, from an electrophotographic drum, to an image fixation.

In order to avoid such drawback, there is proposed a conveying apparatus utilizing an endless belt and attracting the sheet material to such endless belt by electrostatic attraction. In such conveying apparatus of electrostatic attraction belt type, particularly in case of a color image forming apparatus utilizing plural recording heads (image forming means), the conveying speed of the belt has be maintained exactly in order to obtain an exact image forming position by each recording head. In addition, the sheet material has to be maintained in close contact with the conveying member (belt or drum), without displacement or turn-up. For this purpose, Japanese Patent Application Laid-Open No. S50-031828, Japanese Patent Publication No. H03-048100 and Japanese Patent Application Laid-Open No. 2000-247476 disclose a method of providing a conveying belt, for supporting a recording paper, with a pair of conductive electrodes (attraction force generation means) and providing a charge to generate an electrostatic force thereby attracting the recording sheet.

In an ink jet recording apparatus equipped with such conveying means, a recording sheet supplied from a sheet feeding apparatus is, in a recording area, attracted and supported on the surface of the conveying belt by such electrostatic attraction means (conductive electrodes), and is conveyed under a recording by the recording head. A representative structure is described in Japanese Patent Application Laid-Open No. 2000-247476. FIGS. 27 and 28 are respectively a schematic plan view and a schematic lateral view, illustrating a schematic structure of a conveying apparatus having such conveying belt.

Referring to FIGS. 27 and 28, an endless conveying belt 101 is supported around a drive roller 102, a conveying roller 103, and a pressure roller 104 so biased as to maintain the conveying belt 101 at a predetermined tension. A rotary driving power of a driving motor 105 is transmitted through a belt 106 to the driving roller 102, which thus rotates at a predetermined speed to cause the conveying belt 101 to run. A high voltage is applied from an electric power supply brush 107 to plural electrodes 110. The electric power supply brush 107 is given a positive or negative high voltage (electric power) from a high voltage generator 108.

FIG. 29 is a schematic partial plan view showing a part D1 in FIG. 27, and FIG. 30 is a schematic lateral view of the electric power supply brush 107 shown in FIGS. 27 to 29. FIG. 31 shows an electrode pattern (hatched portion), provided under a surface layer of the conveying belt 101. In FIG. 29, an electrode 110 is constituted of plural positive electrodes 110A and plural negative electrodes 110B. Each positive electrode 110A and each negative electrode 110B extend in a direction perpendicular to the conveying direction of the conveying belt 101, and are alternately provided at a predetermined pitch along the conveying direction of the conveying belt 101. The positive electrodes 110A and the negative electrodes 110B are set at a potential difference of several kilovolts. The negative electrode 110B may be connected to a ground potential or given a negative voltage, suitably selected according to conditions of the functions and performance required for the actual equipment.

The positive electrode 110A is provided, at an end portion in the direction of width of the conveying belt 101, with an electric power receiving portion 110A1, and the negative electrode 110B is provided, at an end portion in the direction of width of the conveying belt 101, with an electric power receiving portion 110B1. The voltage supply from the electric power supply brush 107 to the positive electrode 110A and the negative electrode 110B is executed through these electric power receiving portions 110A1, 110B1. Also these electric power receiving portions 110A1, 110B1 are so formed as to be reachable through apertures 101*a*, 101*b* formed in a surface layer of the conveying belt 101. A brush portion of the electric power supply brush 107 contacts the electric power receiving portions 110A1, 110B1 through these apertures 101*a*, 101*b* thereby executing an electric power supply to the electrode 110 (positive electrodes 110A and negative electrodes 110B). An area showing a potential difference between the positive electrode 110A and the negative electrode 110B under the electric power supply constitutes a attraction area 112, as illustrated in FIG. 27.

As the sheet material such as recording paper is a dielectric material such as paper, the sheet material supplied from an upstream side the conveying belt 101 in the conveying direction thereof and placed on the belt becomes polarized, upon reaching the attraction area 112, by an electric field generated in the electrode 110 constituting attraction force generation means. As a result, a mutually attracting electrostatic force is generated between the sheet material and the conveying belt 101, whereby the sheet material is attracted by and supported on the conveying belt 101.

However, the attraction force for the sheet material, generated by a comb-shaped electrode pattern as in the electrode 110, shown in FIGS. 27 to 30, is not necessarily distributed uniformly. A spatial distribution of the electric force lines is variable among an electrode-free portion, an end portion of the electrode and a central portion of the electrode, so that the attraction force is not constant. It is experimentally found that the attraction force is relative strong in an end portion of the electrode and is relative weak in a portion lacking the electrode. Therefore, the sheet material and the electrode should be provided in such a mutual positional relationship as to secure a sufficient attraction force in an end portion of the sheet material where the sheet material tends to be lifted.

On the other hand, in case the attraction force is deficient in an end portion of the sheet material conveyed on the belt, there may result a situation where the end portion of the sheet material is not in close contact with the conveying belt because of a deformation of the sheet such as a curl in the end portion. In case such phenomenon occurs in a situation, for example in an ink jet recording apparatus, where a structure or a mechanism such as a recording head is present closely above the conveying belt, the sheet material under conveying may contact such structure or mechanism. In case the sheet material under conveying comes into contact with such closely positioned structure, the sheet material rapidly loses planarity locally in such contact portion or entirely, thereby resulting in a conveying failure. Also a contact between the sheet material and the recording head may hinder the printing ability of the recording head.

Thus, as shown in FIGS. 27 to 30, the prior electrode pattern is formed in a direction perpendicular to the conveying direction of the sheet material, and no particular attention is paid between the positional relationship between a front end portion of the sheet material, supported on the running conveying belt, and the electrode. It is therefore not possible to suppress a turn-up in an end portion of the sheet material, and is defective in the conveying ability.

Therefore, Japanese Patent Application Laid-Open No. 2000-247476 (patent reference 1) discloses a conveying belt, provided with attraction force generation means constituted of an electrode pattern which is capable of generating a attraction force even for an end portion of the sheet material and which is less influenced by a direction of fibers in the sheet material. A belt conveying apparatus and an image forming apparatus utilizing such conveying belt have a following configuration. In a conveying belt including a belt member having a supporting surface for supporting a sheet material, and attraction force generation means which includes plural opposed electrodes provided in a attraction force generating area provided in a central portion in the width of the conveyed belt member, and an electric power receiving portion provided in at least an end portion of the belt member in the width of the conveyed belt member, for electric power supply to the opposed electrodes, the plural opposed electrodes include an area formed in inclined manner to the direction of width of the conveyed belt member.

Also Japanese Patent Application Laid-Open No. 2000-60168 (patent reference 2) discloses a configuration of a conveying belt for suppressing a turn-up of a front end portion of a sheet material. FIGS. 31 and 32 are schematic plan views showing two examples of such conveying belt. In FIGS. 31 and 32, in a conveying belt in which positive and negative voltages are alternately applied to electrode patterns formed with a constant gap on the surface of a conveying belt 10, thereby conveying a recording medium under an electrostatic attraction, each electrode is so constructed as to be inclined in zigzag manner to the direction of width of a substrate of the conveying belt.

However, the aforementioned prior technologies are associated with following drawbacks. In the technology of Japanese Patent Application Laid-open No. 2000-247476, a contact position and a attraction start position of the sheet material with the conveying belt are not specified, and, when a front end of the sheet material comes into contact with the conveying belt, a attraction force may be exerted over the entire front end. In such case, the attraction force is exerted in the entire contact area starting from the attraction start position, and the attraction force is exerted in the entire contact area even when the contact area increases under the running of the conveying belt. Under a change in environmental conditions such as temperature and humidity, the sheet material may come into contact with the conveying belt in a waved or curled state, and subjected to a attraction force. Thus, when the sheet material is attracted to the belt in a state deformed in a convex shape from the conveying belt, the attraction may take place in a state where air remains in a space between an internal surface of such convex shape and an upper surface of the conveying belt.

In case the sheet material is of a material enabling gas permeation such as a plain paper, the air eventually remaining at the start of attraction can escape through the surface of the sheet material under a attraction force between the conveying belt and the sheet material, thereby enabling a attraction over the entire area without remaining air. However, in case of a sheet material of low air permeation such as a photographic coated paper (Professional Photopaper PR-101, trade name of Canon Inc.), the air remaining between the conveying belt and the sheet material is incapable of passing through the sheet material and therefore remains between the conveying belt and the sheet material, whereby a portion of the sheet material, where the air remains, floats in a convex shape.

Also in Japanese Patent Application Laid-Open No. 2000-60168, a contact start position of the sheet material to the conveying belt, and an electrode position generating a attraction force under an electric power supply are not clearly defined. Therefore, the technology in Japanese Patent Application Laid-Open No. 2000-60168, as in Japanese Patent Application Laid-Open No. 2000-247476, may result in a situation where, in case of a sheet of low air permeation, air remains between the conveying belt and the sheet material to generate a convex floating portion therein, and such floating portion may contact a discharge surface of an ink jet head thereby causing a recording failure.

Also the sheet material conveying apparatus disclosed in Japanese Patent Application Laid-Open No. 2000-247476 does not specify a contact position and a attraction start position of the sheet material with the conveying belt, nor a positional relationship of the electric power supply brush, nor is not suitable for compactization of the apparatus. Also Japanese Patent Application Laid-Open No. 2000-60168, not being clear, in the sheet material conveying belt (medium conveying base member), on a contact start position between the sheet material and the conveying belt and on a position and a range of electrodes generating a attraction force under an electric power supply, is not suitable for compactization of the apparatus, as in the case of Japanese Patent Application Laid-Open No. 2000-247476.

SUMMARY OF THE INVENTION

The present invention has been made in consideration of such technical situation. An object of the present invention is to provide a sheet material conveying apparatus and an image forming apparatus, capable of preventing a floating state of a sheet material by remaining air even in case of belt conveying of a sheet material of low air permeability, thereby preventing a drawback that the floating portion contacts a recording head or the like to induce a recording failure.

Another object of the present invention is to provide a sheet material conveying apparatus and an image forming apparatus, capable of starting a attraction of a sheet material on a conveying belt in a more upstream position in the conveying direction and attaining a compactization of a main body of the apparatus.

The aforementioned objects can be attained, according to the present invention, by a sheet material conveying apparatus for conveying a sheet material under attraction to a conveying belt, including attraction means which, for attracting the sheet material to the conveying belt, exerts a attraction in succession from a front end to a rear end of the sheet material in a conveying direction thereof and from a position in the front end toward both ends in the direction of width.

The aforementioned objects can be attained, according to the present invention, by a sheet material conveying apparatus for conveying a sheet material under attraction to a conveying belt, including attraction means which, for attracting the sheet material to the conveying belt, exerts a attraction in succession from an end at either side in the direction of width of the sheet material and a front end in the conveying direction thereof toward a rear end thereof, and from the either end toward an end at the other side.

Also the aforementioned objects can be attained, according to the present invention, by a sheet material conveying apparatus for conveying a sheet material under electrostatic attraction to a conveying belt having plural electrodes provided in a spaced manner along a conveying direction, wherein each of the plural electrodes has an electric power receiving portion and a sheet material attraction portion of each electrode is positioned at an upstream side, in the conveying direction of the belt, of the electric power receiving portion for such electrode.

In the present invention, attraction means for attracting the sheet material to the conveying belt is so constructed to exert a attraction in succession from a front end to a rear end of the sheet material in the conveying direction thereof and from a position in the front end toward both ends in the direction of width. Such structure allows to execute conveying while pushing out air, present between the sheet material and the conveying belt, both in the conveying direction and in the direction of width thereby preventing a floating of the sheet material by the remaining air even in case of a sheet material of a low air permeability. Thus, there are provided a sheet material conveying apparatus and an image forming apparatus, capable of avoiding a drawback that the floating portion of the sheet material comes into contact with a recording head or the like to induce a recording failure, and of reducing a gap between the sheet material and image forming means thereby attaining an improved image quality in a recorded image.

Also the present invention is so constructed that each of the plural electrodes is provided with an electric power receiving portion and that a sheet material attraction portion of each electrode is positioned at an upstream side, in the conveying direction of the belt, of the electric power receiving portion of the electrode. Thus, there are provided a sheet material conveying apparatus and an image forming apparatus, capable of starting attraction of the sheet material on the conveying belt early in a more upstream position in the conveying direction and achieving compactization of a main body of the apparatus.

DETAILED DESCRIPTION OF THE PREFERRED EMBODIMENTS

Figure 1:
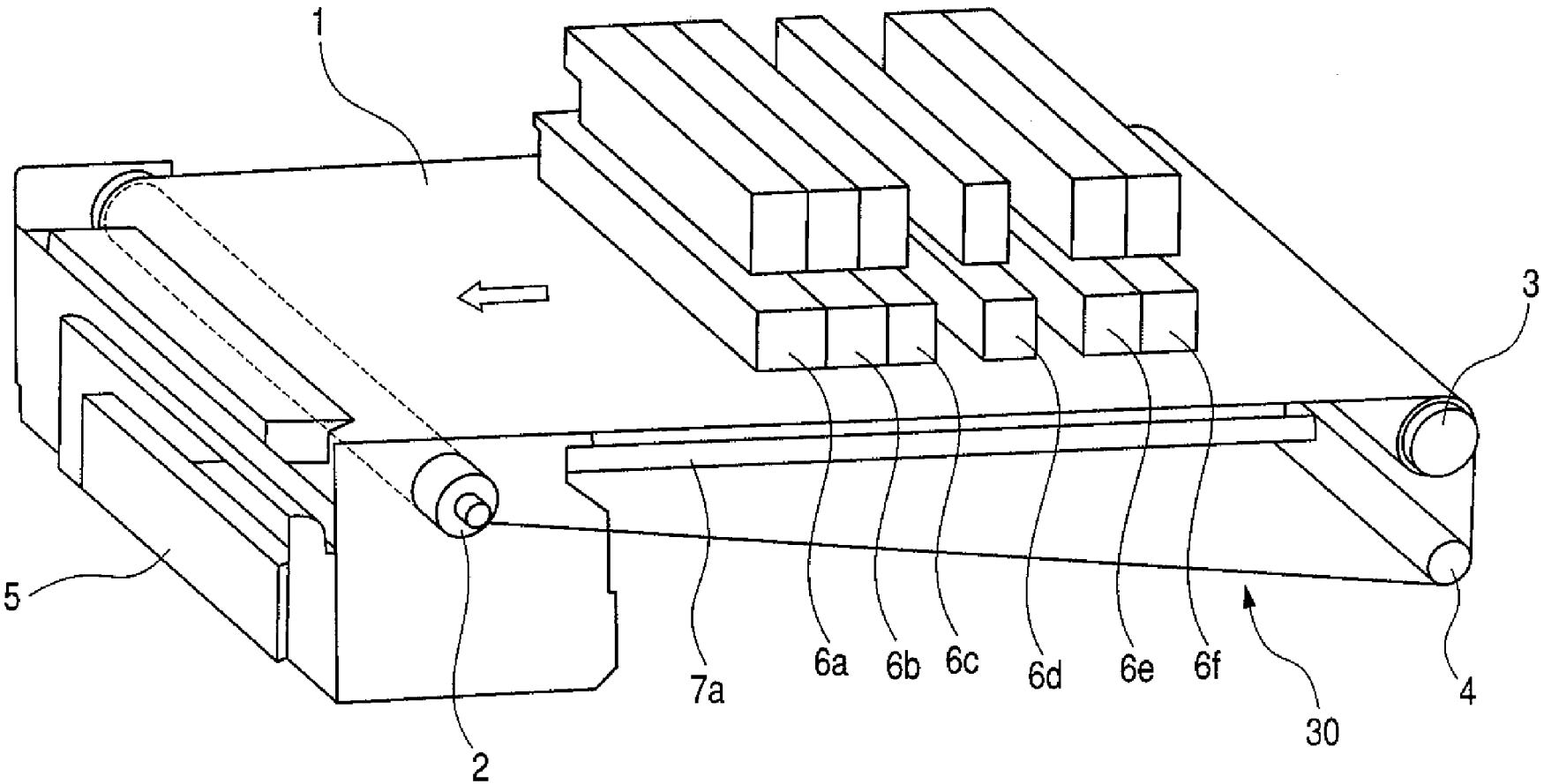
FIG. 1 is a schematic perspective view showing an embodiment of an image forming apparatus provided with a sheet material conveying apparatus of the present invention.
Figure 2:
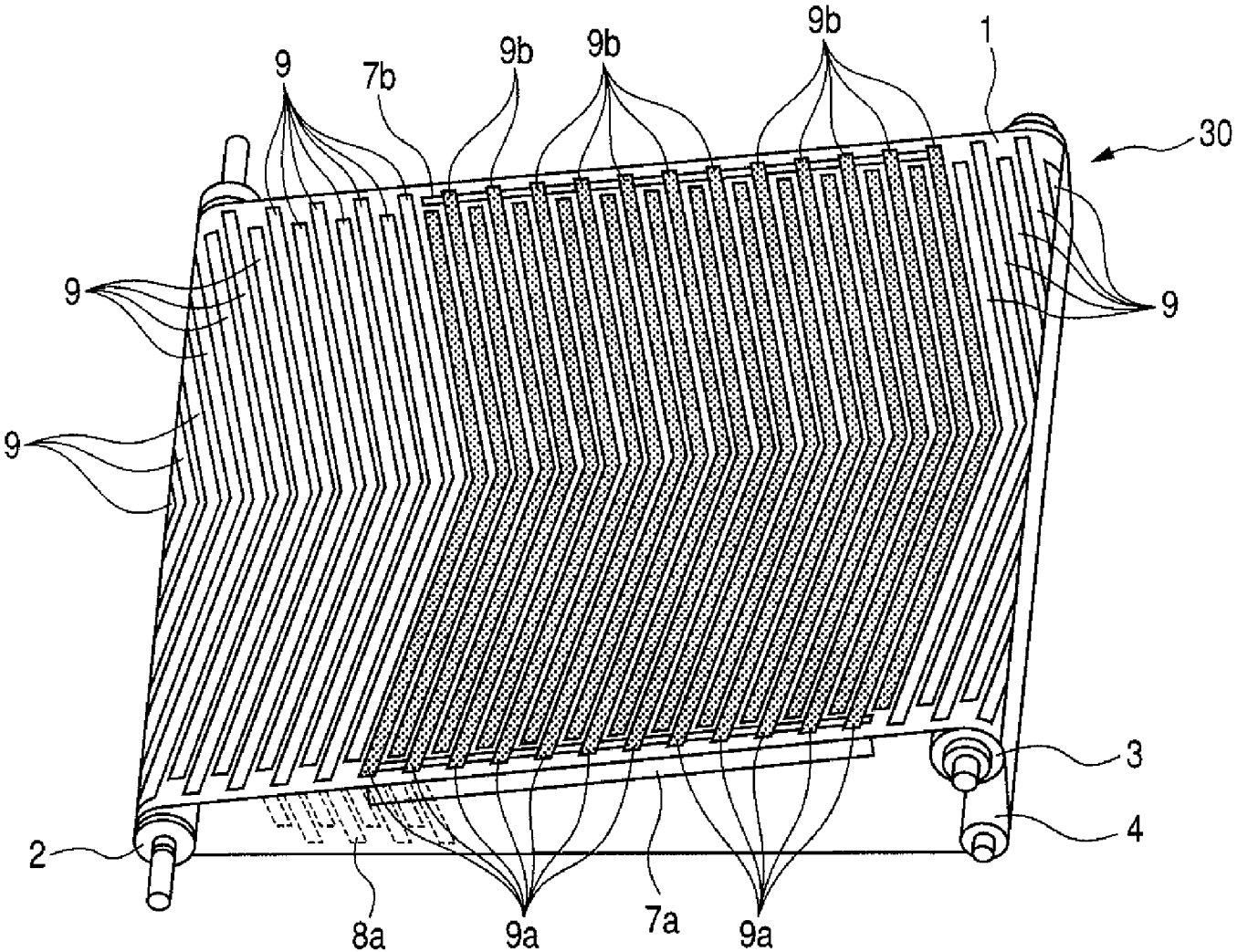
FIG. 2 is a schematic perspective view showing a belt unit in FIG. 1.

In the following, embodiments of the present invention will be explained in detail with reference to the accompanying drawings, in which same or equivalent components are represented by a same symbol. FIG. 1 is a schematic perspective view showing an embodiment of an image forming apparatus provided with a sheet material conveying apparatus of the present invention, and FIG. 2 is a schematic perspective view showing a belt unit in FIG. 1. In the present embodiment, there will be explained, as an example, a case where an image forming apparatus, which is to employ a sheet material conveying apparatus of the present invention, is an ink jet recording apparatus.

Referring to FIG. 1, an ink jet recording apparatus of the present embodiment is equipped with a belt unit 30, serving as a sheet material conveying system constituted of a conveying belt 1, which is an endless belt for conveying a sheet material as a recording medium such as a recording paper under an electrostatic attraction. Above the belt unit 30, there is provided image forming means 6 for forming an image on the sheet material, conveyed by the conveying belt 1 in a direction indicated by an arrow. Also under the belt unit 30, there is provided a belt cleaning unit 5 for wiping off a deposit such as ink, deposited on the conveying belt 1. The image forming means 6 is formed by a full-line multi head system of a structure supporting, by a head frame member, plural full-line heads 6*a*-6*f* for forming an image on the sheet material by ink discharge thereon.

The head frame member, supporting the full-line heads 6*a*-6*f* constituting color image forming means 6, is shifted up and down in a substantially vertical direction by an unillustrated motor. When a recording operation is not executed, the head frame member is lifted to a position separated upwards from the conveying belt 1, and an unillustrated cap unit is positioned between the conveying belt 1 and the full-line heads 6*a*-6*f* to executing a capping operation on each head, thereby avoiding drying of the ink in the vicinity of discharge ports of the heads 6*a*-6*f*. The full-line heads 6*a*-6*f* are positioned in an order, from an upstream side in the conveying direction (indicated by an arrow) of the conveying belt 1, of black, yellow, cyan, light cyan, magenta and light magenta.

The belt unit 30 is provided, as shown in FIGS. 1 and 2, with a conveying belt 1 for conveying the sheet material under electrostatic attraction, a drive roller 2 for driving the conveying belt 1, and an idler roller 3 rotated by the displacement of the conveying belt 1. There is further provided a tension roller 4, for avoiding a slack in the conveying belt 1 between the drive roller 2 and the idler roller 3. The conveying belt 1 is wound around the rollers 2, 3, 4.

Figure 3:
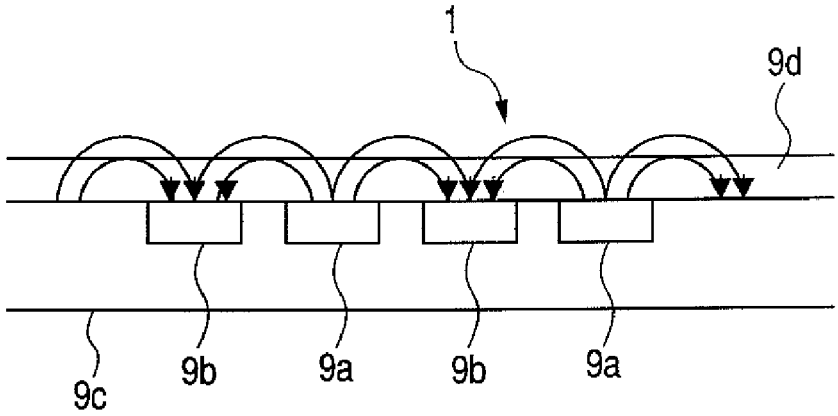
FIG. 3 is a vertical partial cross-sectional view of a conveying belt 1 in FIG. 2, along a conveying direction.

FIG. 3 is a partial vertical cross-sectional view showing a part of the conveying belt 1 in FIG. 2, along the conveying direction. Referring to FIGS. 2 and 3, the conveying belt 1 is formed by embedding a first electrode 9*a* and a second electrode 9*b*, constituted of a conductive metal and constituting attraction means or attraction force generating means, in a belt substrate 9*c* of a resinous material and covering an entire surface with a surface layer 9*d*. The belt substrate 9*c* is formed for example by a synthetic polymer resinous material such as polyethylene, polycarbonate or polyimide. Each of the first electrode 9*a* and the second electrode 9*b* has a slat shape as shown in FIG. 2, which is bent in a convex shape toward the upstream side of the conveying direction, at an approximate center in the direction of width of the conveying belt 1. Plural first electrodes 9*a* and second electrodes 9*b* are provided alternately, with a predetermined gap therebetween and in a mutually parallel relationship. Such plural first electrodes 9*a* and second electrodes 9*b* constitute, as shown in FIG. 2, a bent comb-tooth shape mutually opposed in a direction substantially perpendicular to the conveying direction.

The surface layer 9*d* is formed by a synthetic resin of fluorinated type such as PVDF capable of resistance control, in order to generate an optimum electrostatic force. FIG. 2 also illustrate an electrode pattern of the conveying belt of the present embodiment. The electrodes 9*a*, 9*b* are provided, in end portions in the direction of belt width, with electric power receiving portions, to be contacted, from the rear side of the belt, by electric power supply brushes for supplying the electrodes with voltages. An electric power receiving portion (first electric power receiving portion) 8*a* of the first electrode 9*a* is so formed as to be contactable from the rear side, at a left end portion of the conveying belt 1 in the conveying direction thereof, and an electric power receiving portion (second electric power receiving portion) 8*b* of the second electrode 9*b* is so formed as to be contactable from the rear side, at a right end portion of the conveying belt 1.

The electric power receiving portions 8*a*, 8*b* are exposed to the rear surface of the conveying belt 1 by apertures provided in the belt substrate 9*c*, thus being rendered contactable. Conductive electric power supply brushes 7*a*, 7*b* for voltage application respectively contact, under predetermined pressures, the electric power receiving portions 8*a*, 8*b* through such apertures. The electric power supply brushes 7*a*, 7*b* are fixed to an unillustrated frame provided within a space inside the endless conveying belt 1 supported by the rollers 2, 3, 4, and are respectively connected to unillustrated high voltage generators. The electric power receiving portion 8*a* receives, through the electric power supply brush 7*a*, a positive high voltage (0.5 to 1.5 kV) from the unillustrated high voltage generator, and the electric power receiving portion 8*b* receives, through the electric power supply brush 7*b*, a negative high voltage (−0.5 to −1.5 kV) from the unillustrated high voltage generator.

The electric power supply brush is preferably formed by an electroconductive material with a volumic resistivity of $10^5$ Ωcm. The voltages applied to the electrodes 9*a*, 9*b* generate an electric force in a direction of an arrow in FIG. 3, thereby forming electric force lines. Then a potential difference between the electrodes 9*a*, 9*b* generates a attraction force above the conveying belt 9, thereby attracting the sheet material to the conveying belt. In FIG. 2, the electrodes 9*a*, 9*b* indicate those under voltage applications while the electrodes 9 indicate those without a voltage application, whereby a attraction force to the sheet material is exerted in the portion of the electrodes 9*a*, 9*b*. Even when different electrodes come into contact with the electric power supply brushes 7*a*, 7*b* by the displacement of the conveying belt 1, the attraction force area does not show a significant change and the attraction force is generated approximately in the area of the electrodes 9*a*, 9*b*.

Figure 4:
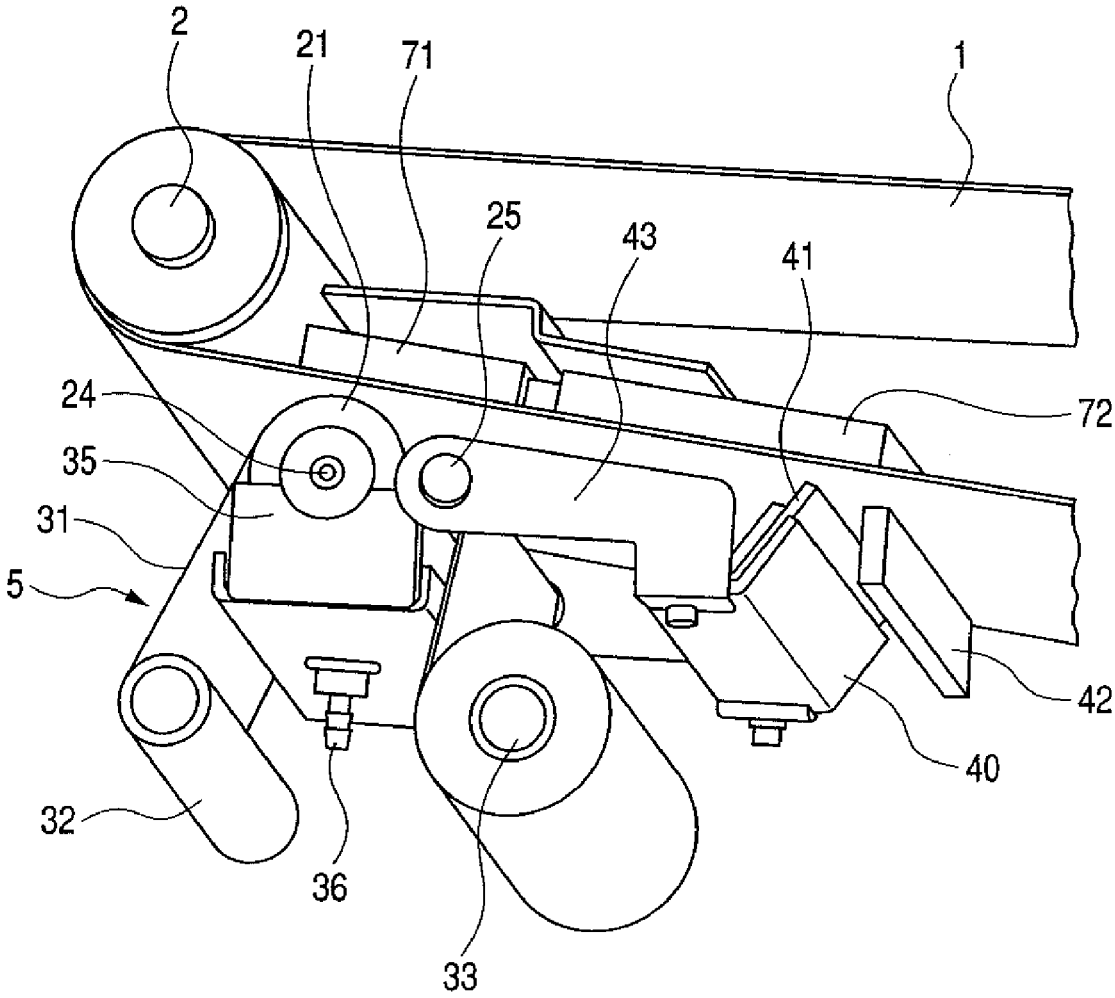
FIG. 4 is a schematic perspective view showing a cleaning state of the conveying belt with a rubber blade in a belt cleaning unit shown in FIG. 1.
Figure 5:
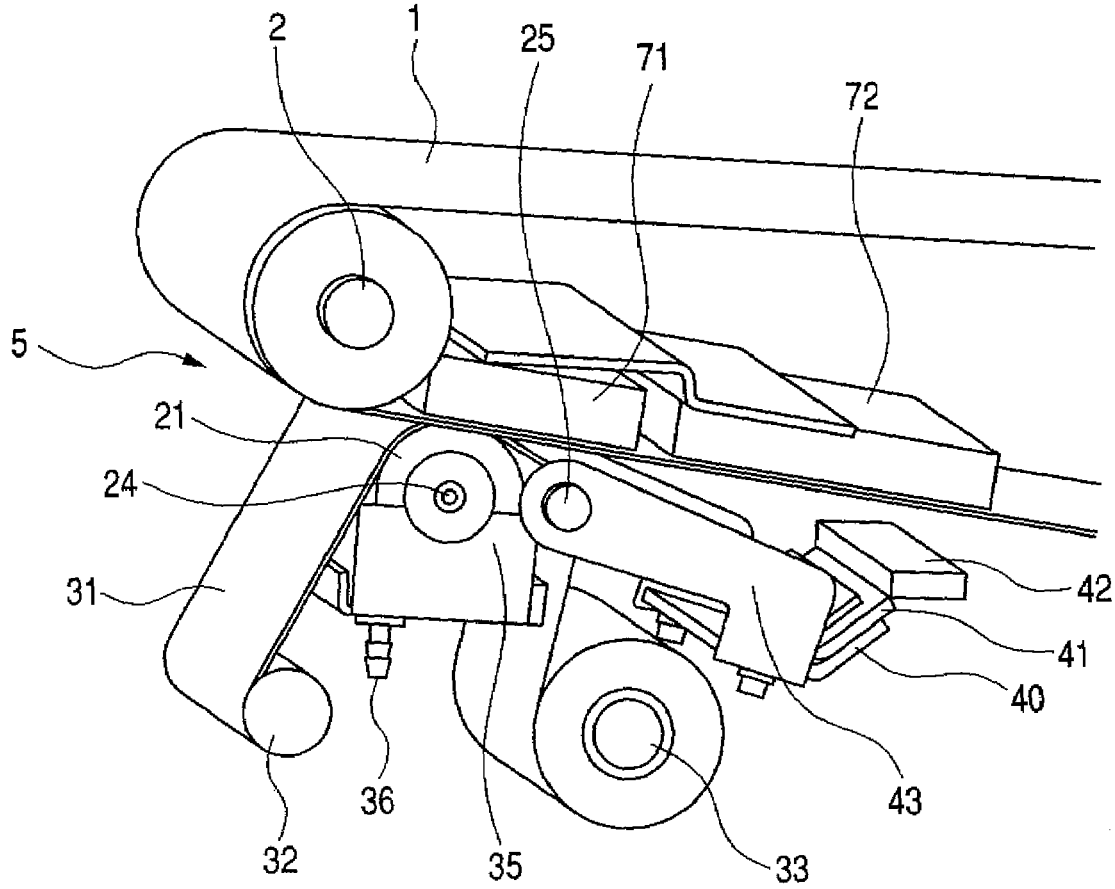
FIG. 5 is a schematic perspective view showing a state where a liquid on the rubber blade is absorbed by an absorbent member in the belt cleaning unit shown in FIG. 1.

FIG. 4 is a schematic perspective view showing a cleaning state of the conveying belt with a rubber blade in a belt cleaning unit 5 shown in FIG. 1. Also FIG. 5 is a schematic perspective view showing a state where a liquid on the rubber blade is absorbed by an absorbent member in the belt cleaning unit 5 shown in FIG. 1. As shown in FIG. 1, the belt cleaning unit 5 for cleaning the conveying belt 1 is mounted parallel to a rotary axis of the drive roller 2.

Referring to FIGS. 4 and 5, the belt cleaning unit 5 is provided with a web 31 for collecting extraneous matters such as paper dusts on the conveying belt 1. The web 31 prevents the extraneous matters such as paper dusts on the conveying belt 1 from going to the downstream side beyond the web 31. The web 31 is formed by a non-woven cloth with an increased liquid absorbing ability for example by a surfactant impregnation on the surface, and has a width larger than a recording width of the full-line heads 6*a*-6*f* and smaller than the width of the conveying belt 1. The web 31 is adhered at a leading end and a trailing end thereof respectively to cores 32, 33 and mainly wound on the core 33 as shown in FIGS. 4 and 5 at the start of use.

Then the web 31 is advanced in a direction opposite to the moving direction (conveying direction) of the conveying belt 1 through a rotation of the core 32 by an unillustrated drive source, thus being taken up on the core 32. The web 31 is supported, in a course thereof, by a web roller 21 and a shaft 25 so as to be in a frictional contact with the conveying surface of the conveying belt 1. In the present embodiment, the web 31 is formed by a non-woven cloth with an increased liquid absorbing ability, but such material is not restrictive. The web 31 is required to be capable of collecting extraneous matters such as paper dusts on the conveying belt 1, not to generate extraneous matters by a friction with the conveying belt 1, also capable of absorbing a cleaning liquid without repellency thereto and to have a resistance to ink, and any other material meeting these requirements may be employed.

The web roller 21 has a cylindrical form and is provided, at an end thereof, with a cleaning liquid supply port 24. The cylindrical surface of the web roller 21 is provided with plural holes, communicating with the cleaning liquid supply port 24, so as to be mutually connected along the direction of length. The cleaning liquid supply port 24 is connected to an unillustrated tube, from which a cleaning liquid can be supplied to the cylindrical surface of the web roller 21 through the cleaning liquid supply port 24 and the plural holes. Under the web roller 21 there is provided a cleaning liquid receiver 35 which receives the overflowing cleaning liquid thereby preventing spilling into the main body of the apparatus. The cleaning liquid receiver 35 is provided, in a bottom surface thereof, with a discharge port 36 for discharging the cleaning liquid accumulated in the cleaning liquid receiver 35, and the discharge port 36 is connected to an unillustrated tube to recover the overflowing cleaning liquid through such tube in a used liquid tank.

In a position opposed to the web roller 21 across the conveying belt 1, there is provided a web backup plate 71, which is fixed on an unillustrated frame so as to be in a planar contact with the rear surface of the conveying belt 1. The web backup plate 71 prevents a fluttering of the conveying belt 1 and assists the pressing of the web 31 to the conveying belt 1. In the belt cleaning unit 5 and in the downstream side of the web roller 21 in the moving direction of the conveying belt 1, a rubber blade 41 is provided for wiping off a liquid on the conveying belt 1. The rubber blade 41 is formed by plate-shaped urethane rubber, with a thickness of about 1.5 mm and a width slightly smaller than the width of the web 31. The rubber blade 41 is fixed to a blade base 40. A base end portion of the blade base 40 is fixed to a rotary support plate 43, rotatably supported on a shaft 25. The rotary support plate 43 is lined to an unillustrated driving source, and is rotated to an operating position as shown in FIG. 4 where the rubber blade 41 wipes off a liquid on the conveying belt, or to a cleaning position as shown in FIG. 5 where a liquid deposited on the rubber blade 41 is eliminated by absorption by an absorbent member 42. The absorbent member 42 has a length somewhat larger than that of the rubber blade 42, in order to be able to contact the entire front end of the rubber blade 41. The absorbent member 42 is formed by a polyurethane porous member, and, since a liquid absorbing property and an ink resistance are required, it is formed in the present embodiment by Rubicel (trade name, manufactured by Toyo Polymer Ltd.). However the material constituting the absorbent member 42 is not limited to the foregoing as long as it has a liquid absorbing property and an ink resistance.

The absorbent member is rotatably supported by an unillustrated support member, so as to assume two positions shown in FIGS. 4 and 5, according to the rotational position of the rubber blade 41. It is thus rendered possible, after the rubber blade 41 contacts the conveying blade 1 and wipes off the liquid deposited thereon and when the rubber blade 41 is released from the contact with the conveying belt 1, to absorb and eliminate, by the absorbent member 42, the liquid scraped by the rubber blade 41 and deposited on the end portion thereof. Thus, when the liquid wiping operation is not conducted on the conveying belt 1, the end portion of the rubber blade 41 can be always maintained in a clean state.

Also as shown in FIGS. 4 and 5, a blade backup plate 72 is provided in a position opposed to the rubber blade 41 across the conveying belt 1. Like the web backup plate 71, the blade backup plate 72 is fixed to an unillustrated frame so as to be in a planar contact with the rear surface of the conveying belt 1. The blade backup plate 72 is provided in such a positional relationship as to pinch the conveying belt 1 in cooperation with the end portion of the rubber blade 41. Such arrangement allows to prevent a fluttering of the conveying belt 1 and to securely eliminate the ink and the cleaning liquid sticking to the conveying belt 1 even when it executes a high-speed rotation.

Figure 6:
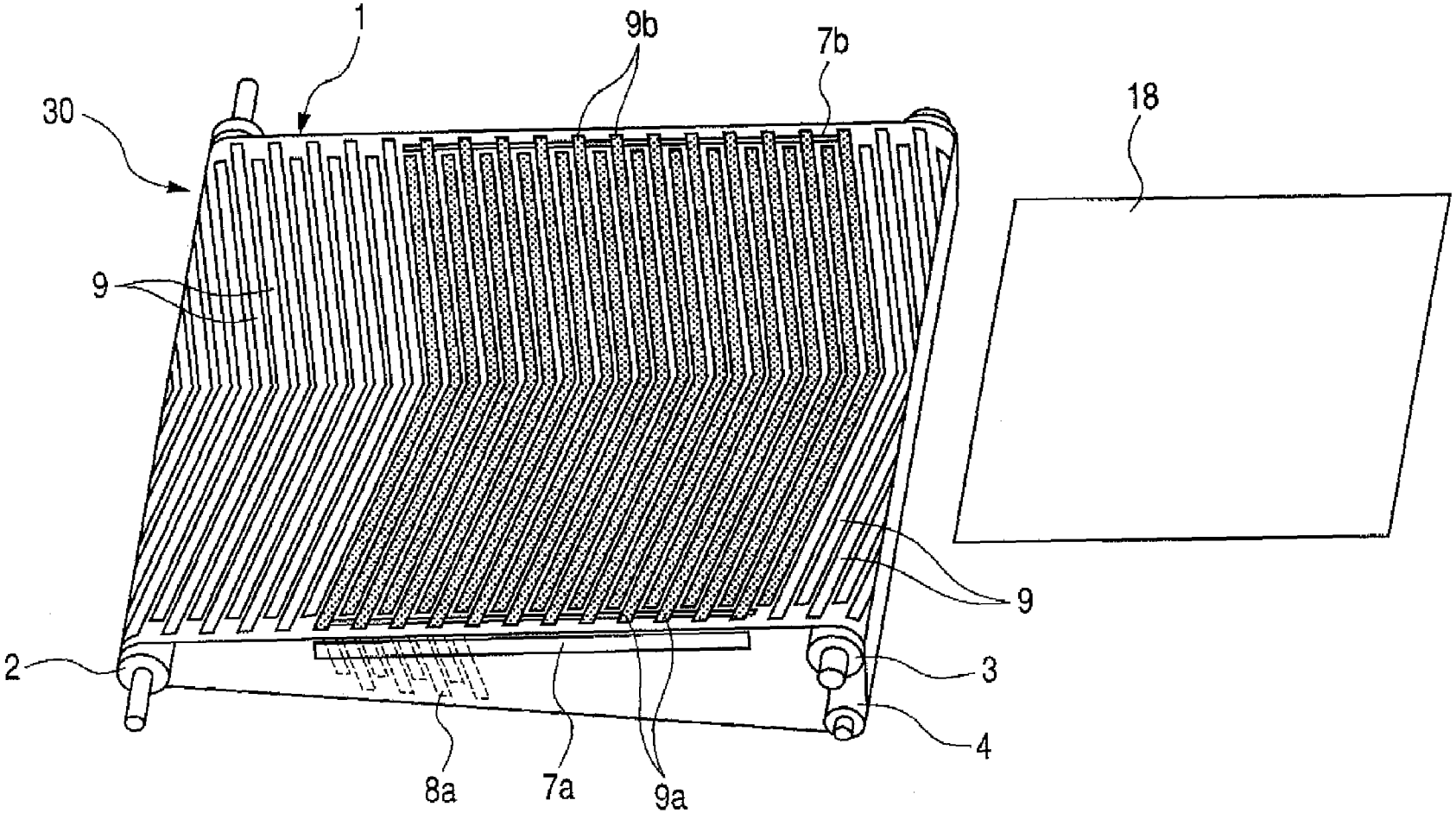
FIG. 6 is a schematic perspective view showing a state where a sheet material is conveyed to a position in front of the belt unit.
Figure 7:
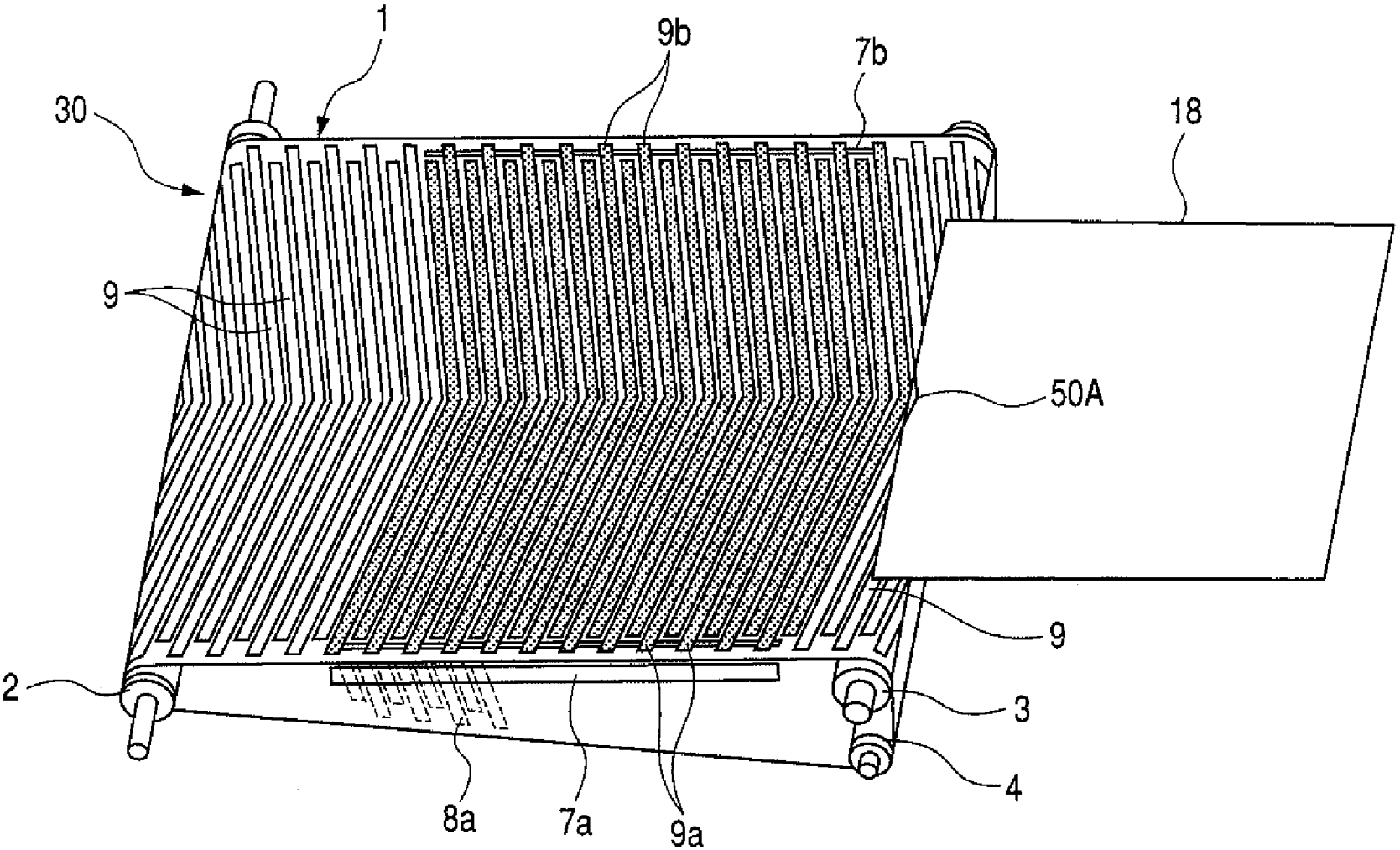
FIG. 7 is a schematic perspective view showing a state where the sheet material is conveyed further from the state shown in FIG. 6 to a position where a front end of the sheet material is in contact with the conveying belt.
Figure 8:
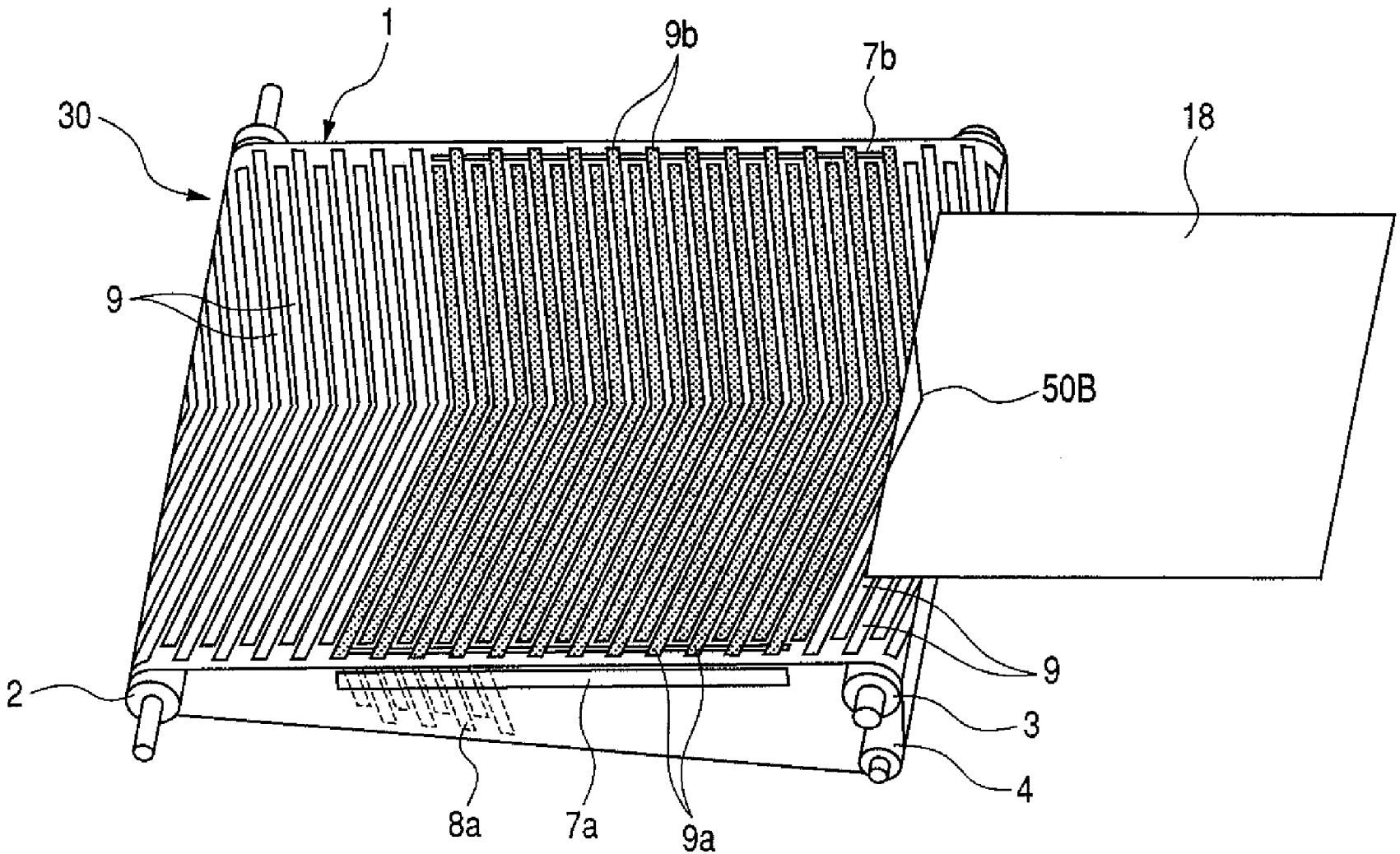
FIG. 8 is a schematic perspective view showing a state where the sheet material is conveyed further from the state shown in FIG. 7 and the conveying belt forms a attraction force area to the sheet material.
Figure 9:
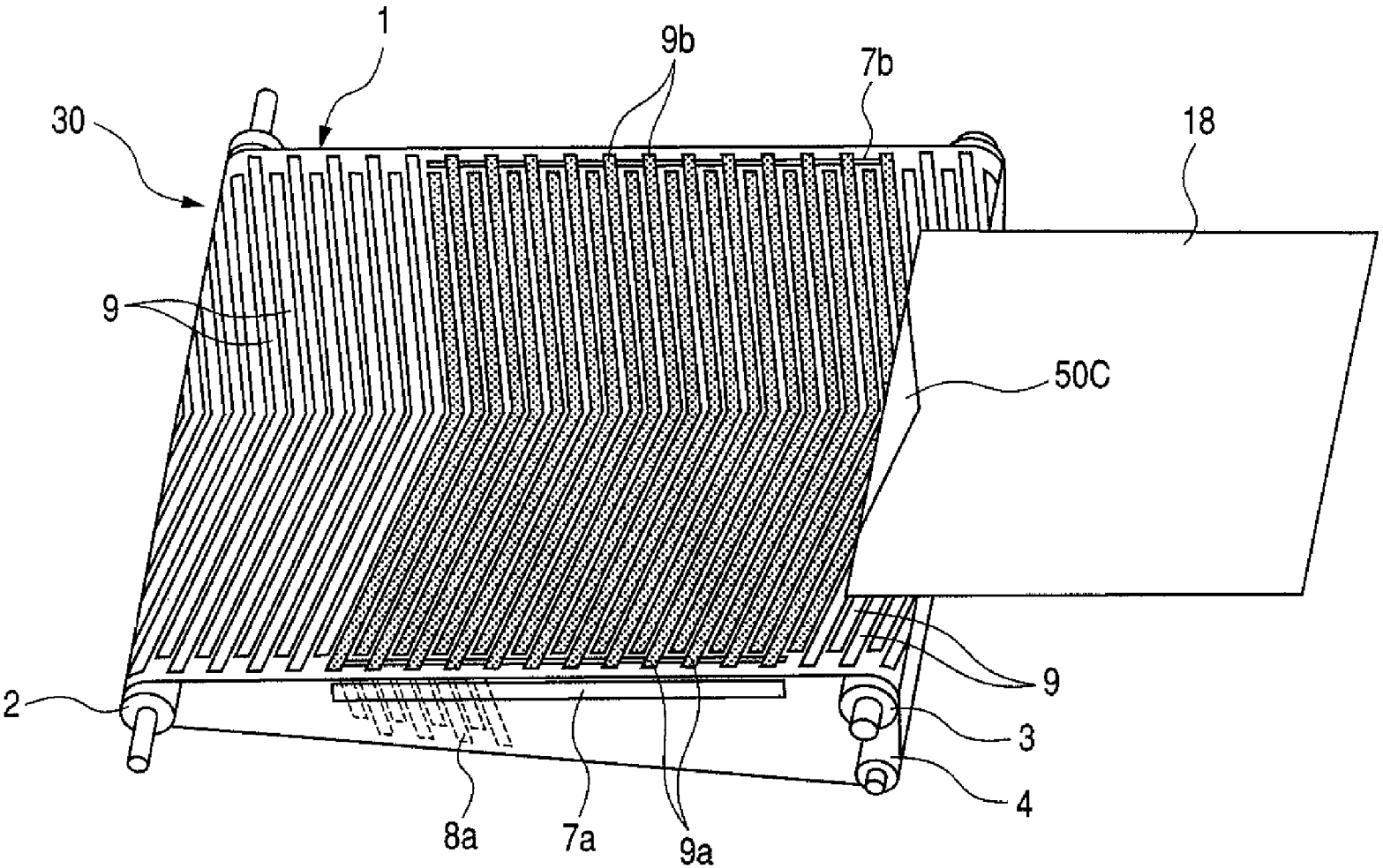
FIG. 9 is a schematic perspective view showing a state where the sheet material is conveyed further from the state shown in FIG. 8 and the attraction force area to the sheet material is somewhat widened.

FIGS. 6 to 14 are schematic perspective views showing operations when a sheet material 18 is conveyed under attraction by a belt unit 30. FIG. 6 shows a state where the sheet material is conveyed to a position in front of the belt unit, and FIG. 7 shows a state where the sheet material is conveyed further from the state shown in FIG. 6 to a position where a front end of the sheet material is in contact with the conveying belt. FIG. 8 shows a state where the sheet material is conveyed further from the state shown in FIG. 7 and the conveying belt forms a attraction force area to the sheet material, and FIG. 9 shows a state where the sheet material is conveyed further from the state shown in FIG. 8 and the attraction force area to the sheet material is somewhat widened.

Figure 10:
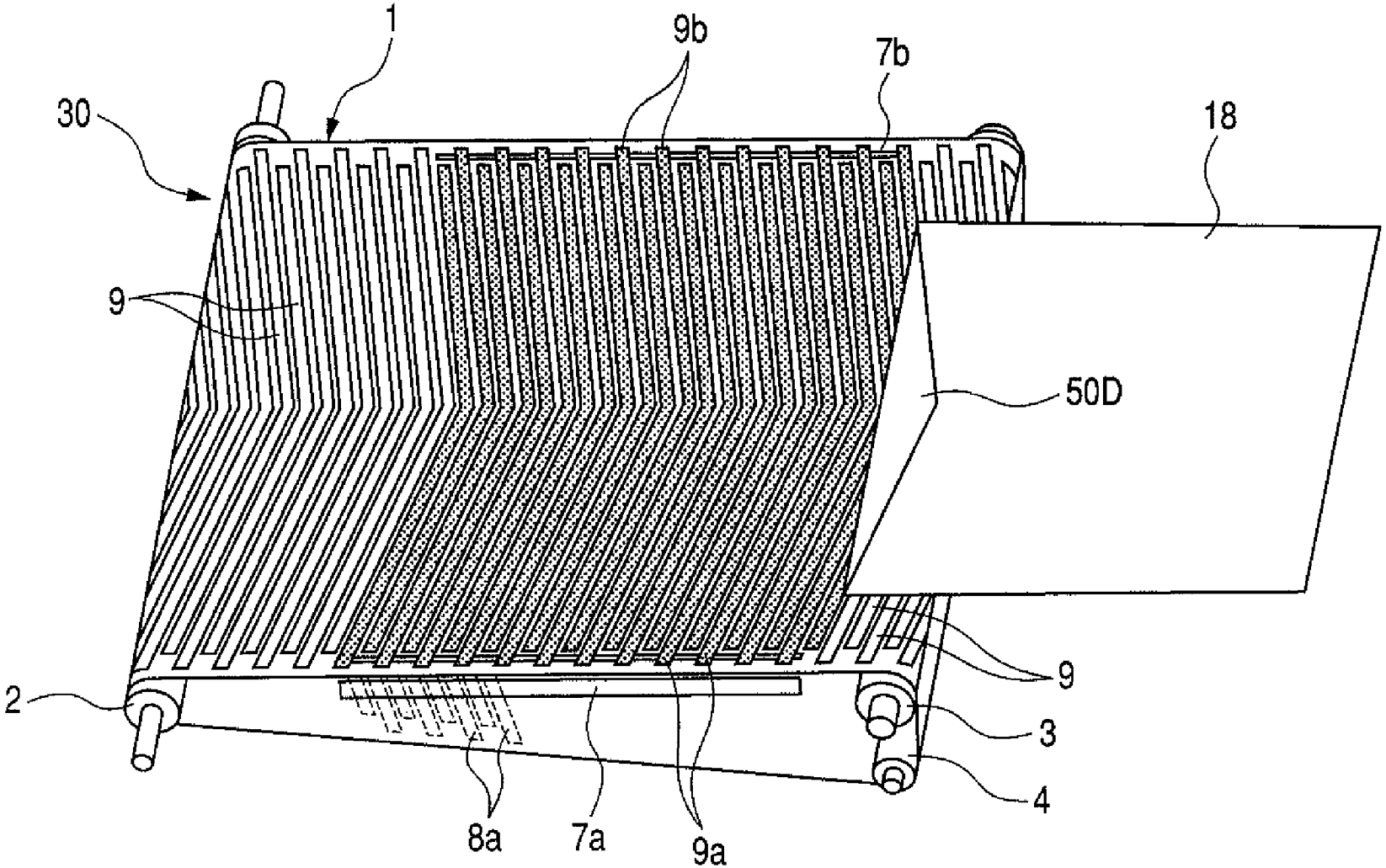
FIG. 10 is a schematic perspective view showing a state where the sheet material is conveyed further from the state shown in FIG. 9 and the attraction force area to the sheet material is further widened to both lateral ends.
Figure 11:
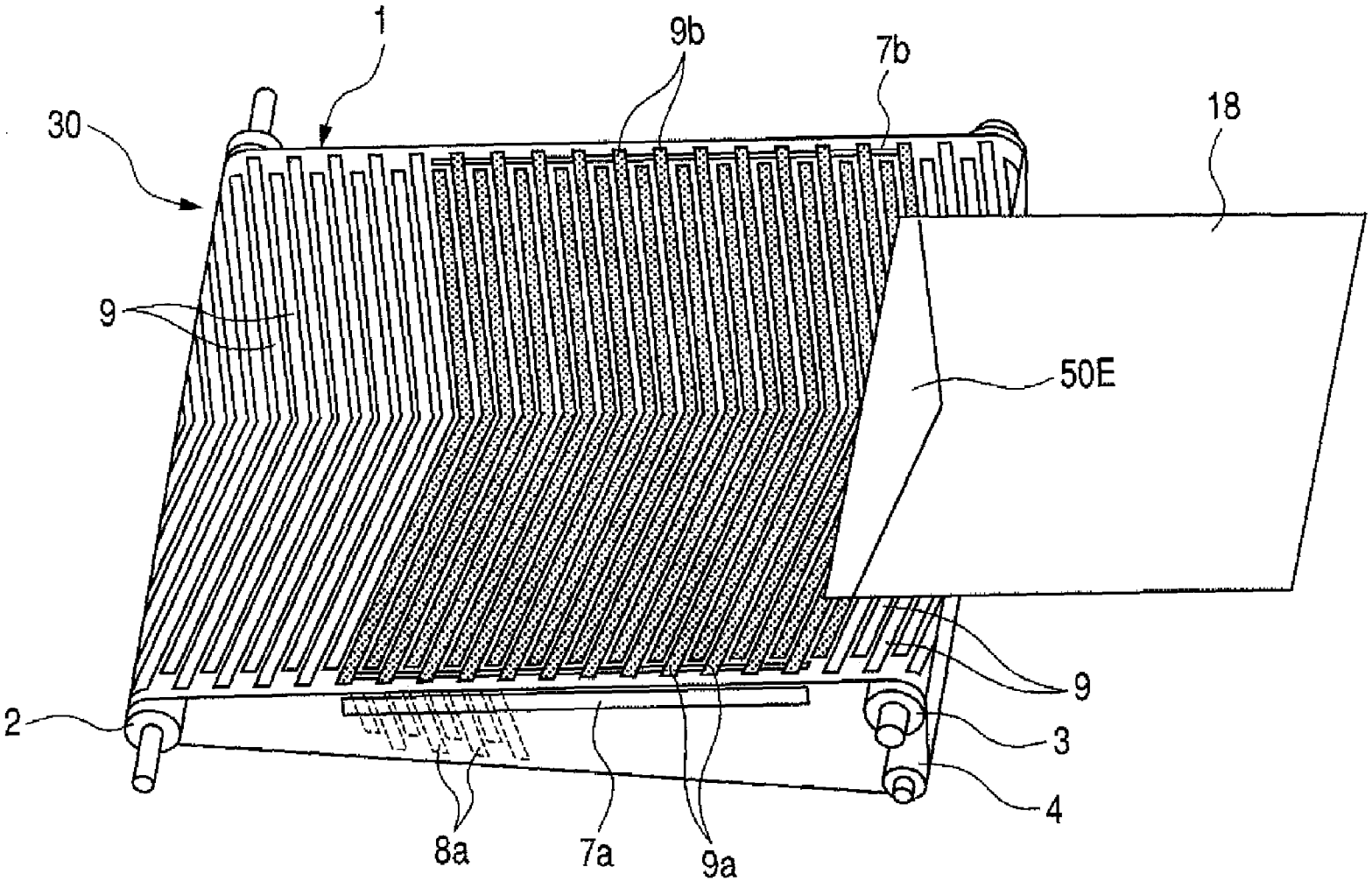
FIG. 11 is a schematic perspective view showing a state where the sheet material is conveyed further from the state shown in FIG. 10 and the attraction force area from the conveying belt to the sheet material is further widened to the rear side.
Figure 12:
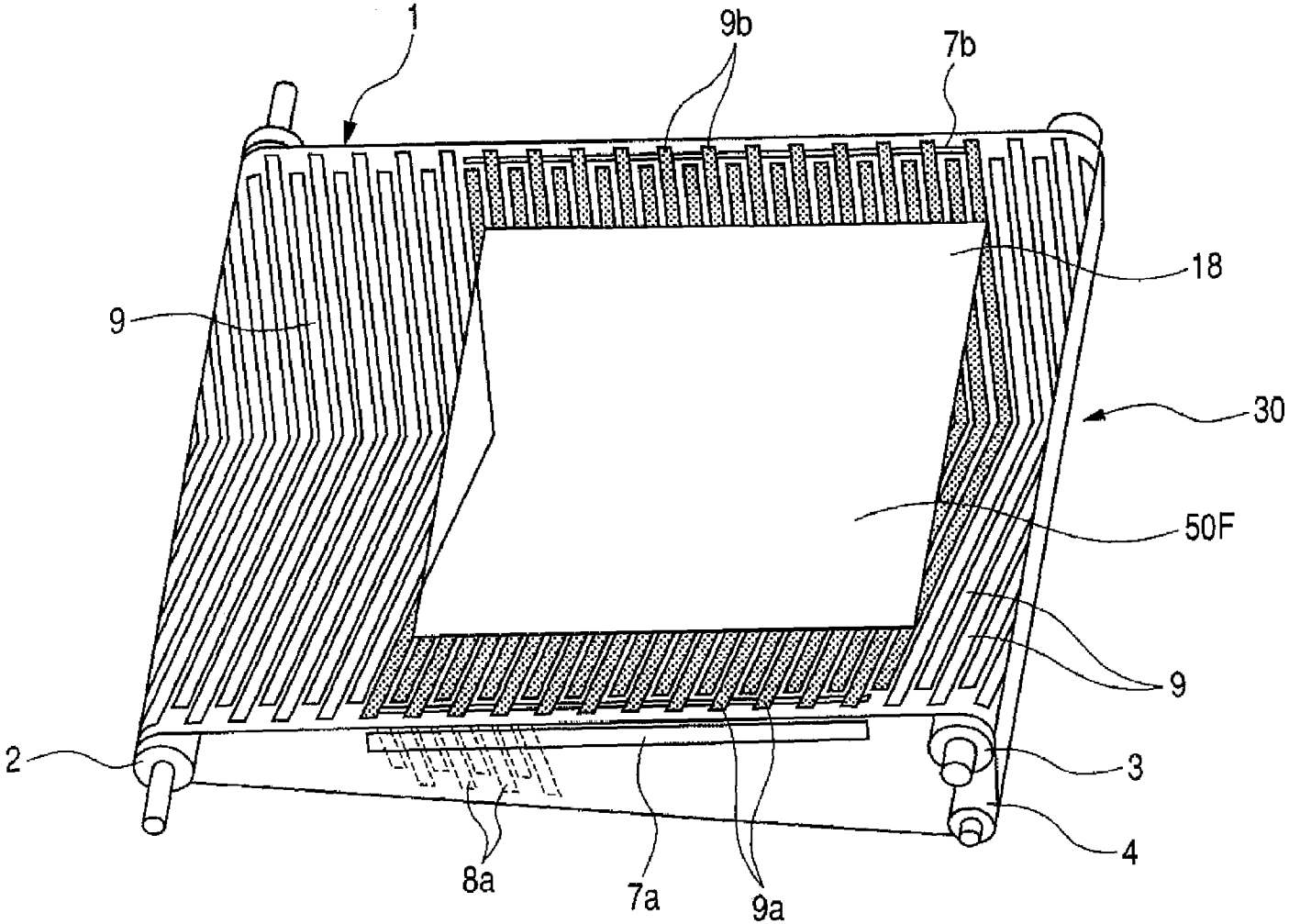
FIG. 12 is a schematic perspective view showing a state where the sheet material is conveyed further from the state shown in FIG. 11 and the attraction force area from the conveying belt to the sheet material covers the substantially entire sheet material.
Figure 13:
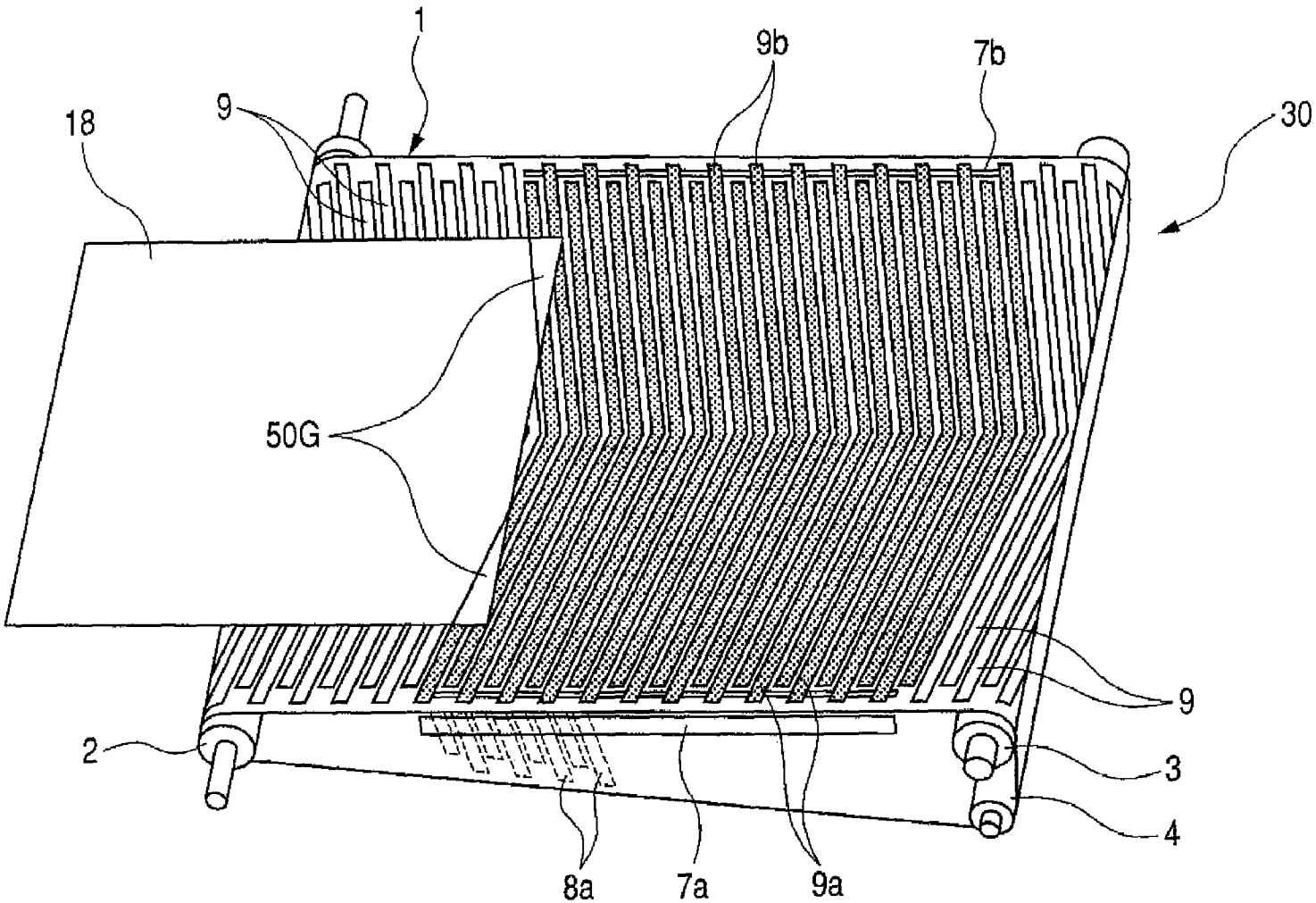
FIG. 13 is a schematic perspective view showing a state where the sheet material is conveyed further from the state shown in FIG. 12 and the attraction force area to the sheet material is limited to a rear end portion.
Figure 14:
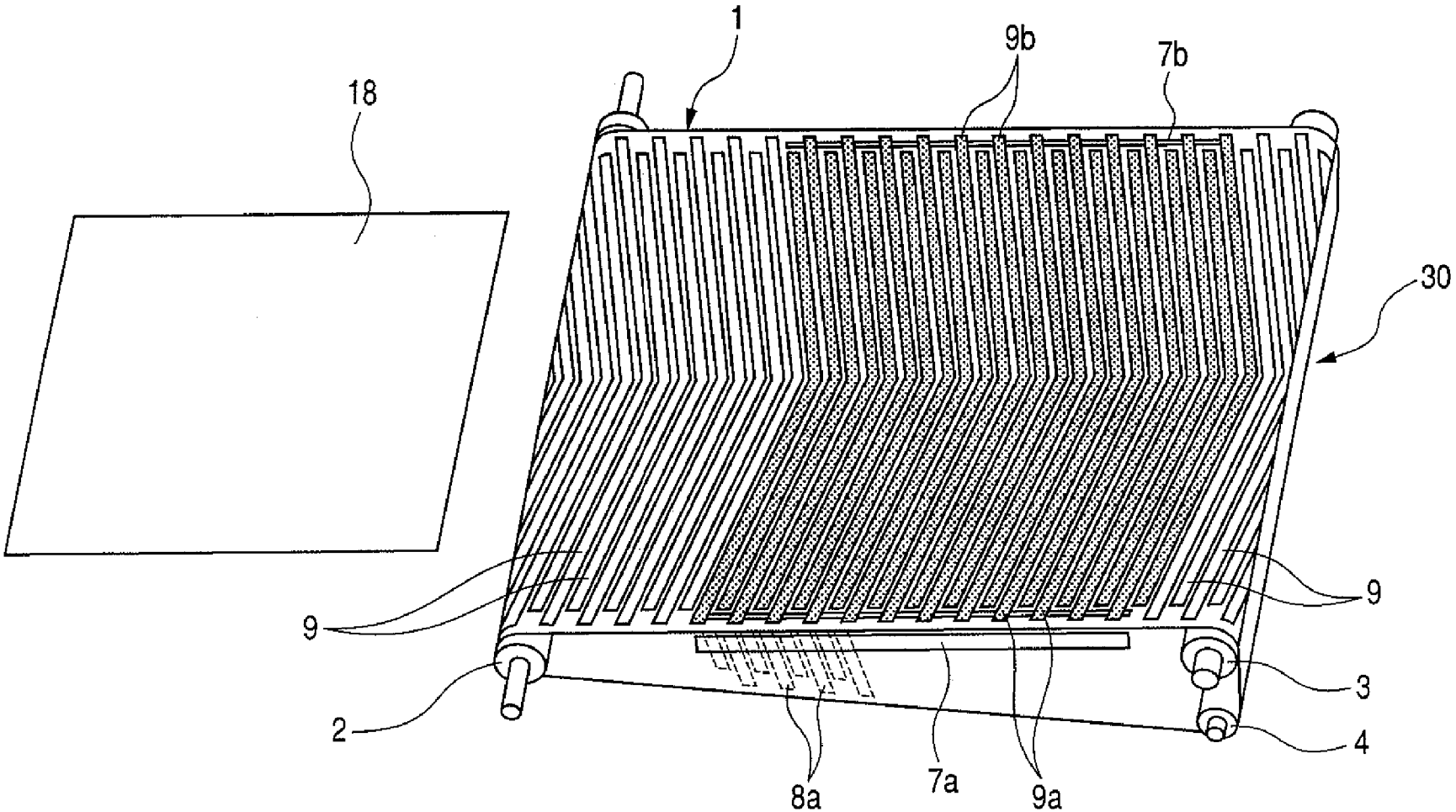
FIG. 14 is a schematic perspective view showing a state where the sheet material is conveyed further from the state shown in FIG. 13 and the sheet material is separated from the conveying belt and discharged.

FIG. 10 shows a state where the sheet material is conveyed further from the state shown in FIG. 9 and the attraction force area to the sheet material is further widened to both lateral ends. FIG. 11 shows a state where the sheet material is conveyed further from the state shown in FIG. 10 and the attraction force area from the conveying belt to the sheet material is further widened to the rear side. FIG. 12 shows a state where the sheet material is conveyed further from the state shown in FIG. 11 and the attraction force area from the conveying belt to the sheet material covers the substantially entire sheet material. FIG. 13 shows a state where the sheet material is conveyed further from the state shown in FIG. 12 and the attraction force area to the sheet material is limited to a rear end portion. FIG. 14 shows a state where the sheet material is conveyed further from the state shown in FIG. 13 and the sheet material is separated from the conveying belt and discharged.

Now the operations of conveying the sheet material 18 under attraction by the belt unit 30 will be explained with reference to FIGS. 6 to 14, which illustrate operation states when the A4-sized sheet material 18 is conveyed from the upstream side of the belt unit 30, then attracted by the conveying belt 1 and finally discharged to the downstream side.

In FIG. 6, the sheet material 18 such as a recording paper or a thin plastic sheet is conveyed for example by an unillustrated sheet feeding apparatus to a position in front of the belt unit 30, parallel to and with a same height as the upper surface of the conveying belt 1. In this state, the endless conveying belt 1 starts to run by a driving power transmitted from the drive roller 2 and, at the same time, the unillustrated high voltage generators start to apply high voltages to the electrodes 9*a*, 9*b* through the electric power supply portions (electric power supply brushes) 7*a*, 7*b* and the electric power receiving portions 8*a*, 8*b*. A voltage of +1.0 kV is applied to the first electrode 9*a* in contact with the electric power supply brush 7*a* at the electric power receiving portion 8*a*, and a voltage of −1.0 kV is applied to the second electrode 9*b* in contact with the electric power supply brush 7*b* at the electric power receiving portion 8*b* of the opposite side. Thus, a attraction force for the sheet material is generated in the area of the electrodes 9*a*, 9*b* under such voltage application.

Then, when the sheet material is conveyed further from the state of FIG. 6 to a position where the front end of the sheet material 18 contacts the conveying belt 1 as shown in FIG. 7, only a central portion of the front end of the sheet material 18 is in contact with the electrode generating the attraction force. Therefore, an area 50A showing a attraction force to the sheet material 18 is limited to the central portion of the front end of the sheet material 18. Thus, the structure of the belt unit 30, the shape of the electrodes 9*a*, 9*b* and the positional relationship of the electric power supply brushes 7*a*, 7*b* are so selected that, in a situation where the conveying belt 1 and the sheet material 18 are in an initial contact, the attraction force is exerted only in the central portion of the front end of the sheet material.

When the sheet material 18 is further conveyed to a position shown in FIG. 8, the attraction force from the conveying belt 1 to the sheet material is applied to an area 50B shown in FIG. 8. The area 50B in FIG. 8, in comparison with the area 50A in FIG. 7, spreads toward the rear end of the sheet material 18 and also spread, in the direction of width of the sheet material, from the central portion toward both end portions. When the sheet material 18 is further conveyed to a position shown in FIG. 9, the attraction force from the conveying belt 1 to the sheet material is applied to an area 50C shown in FIG. 9. The area 50C in FIG. 9, in comparison with the area 50B in FIG. 8, spreads toward the rear end of the sheet material 18 and also spread from the central portion toward both end portions, in the direction of width of the sheet material.

Then, when the sheet material 18 is further conveyed to a position shown in FIG. 10, the attraction force from the conveying belt 1 to the sheet material is applied to an area 50D shown in FIG. 10. The area 50D in FIG. 10, in comparison with the area 50C in FIG. 9, spreads toward the rear end of the sheet material 18. Also in the direction of width of the sheet material, it is further spread from the central portion toward both end portions, and the entire front end of the sheet material 18 is under attraction in the state shown in FIG. 10.

When the sheet material 18 is further conveyed to a position shown in FIG. 11, the attraction force from the conveying belt 1 to the sheet material is applied to an area 50E shown in FIG. 11. The area 50E in FIG. 11, in comparison with the area 50D in FIG. 10, spreads further toward the rear end of the sheet material 18. In FIG. 11, a triangular 50D having a bottom of the entire width as shown in FIG. 10 is further displaced toward the rear side of the sheet material 18. Therefore, the attraction force area in FIG. 11 becomes wider than that 50D in FIG. 10, by a rectangular area defined by the further moved distance and the width of the sheet material 18.

When the sheet material 18 is further conveyed to a position shown in FIG. 12, the attraction force from the conveying belt 1 to the sheet material is applied to an area 50F shown in FIG. 12. The area 50F in FIG. 12 covers an approximately entire area of the sheet material 18, which is therefore subjected to attraction over the substantially entire area. However, starting from the situation in FIG. 12, in contrast to the initial state of attraction, a non-attracted area is generated and becomes wider. More specifically, from the state shown in FIG. 12, such non-attracted area spreads from the central portion of the front end of the sheet material 18 toward a more rear portion thereof and also, in the direction of width, from the central portion toward both ends.

When the sheet material 18 is further conveyed to a position shown in FIG. 13, the attraction force from the conveying belt 1 to the sheet material is applied to an area 50G shown in FIG. 13. The area 50G in FIG. 13 decreases only to both end portions at the rear end of the sheet material 18, which is therefore subjected to attraction only in such both end portions at the rear end. Then, when the sheet material 18 is further conveyed, it finally reaches a position shown in FIG. 14, in which the sheet material 18 is separated from the conveying belt 1 and is discharged to the exterior of the main body of the apparatus.

In the embodiment explained in the foregoing, the sheet material 18 is conveyed under attraction by the conveying belt 1 in such manner that the attraction area by the conveying belt 1 spreads from the central portion of the front end of the sheet material toward the rear side and also toward both lateral ends. Therefore the sheet material 18 is so attracted as to expel the air present between the sheet material and the conveying belt 1 not only toward rear side in the conveying direction but also toward both lateral ends. It is therefore possible to reduce or eliminate, in the course of the conveying under attraction, the air remaining between the sheet material. 18 and the conveying belt 1.

Thus attraction and conveying of the sheet material can be achieved without residual air contained between the sheet material and the conveying belt, even in case of a sheet material of a smooth surface property and a low gas permeability such as a glossy paper. It is thus possible to avoid a floating state of the sheet material in the course of conveying and to eliminate a distortion in the recorded image resulting from a frictional contact between the sheet material and a structural component such as a recording head. Also as the sheet material is free from a floating state, the recording head can be positioned closer to the sheet material, thereby reducing a flying distance of the discharged ink in case of an ink jet recording. Therefore, even in case of a "deviation" phenomenon where the ink is discharged obliquely from the discharge port, the image can be formed without a significant displacement of a landing position of the ink droplet from a desired position, whereby a recording apparatus capable of recording with a higher image quality can be obtained.

The present embodiment is so constructed that the attraction force is generated, in the contact start position of the sheet material 18 with the conveying belt 1, from the central portion of the front end of the sheet material. This configuration may be modified in the position of the electric power supply brushes or in the shape of the electrodes of the conveying belt, in such a manner that the attraction force is generated from the central portion of the front end of the sheet material after the sheet material is conveyed over a predetermined distance in a state in contact with the conveying belt. Also in case the position of the electric power supply brushes remains unchanged, the electrodes may be modified to a form with a larger bending angle, and such configurations can provide similar effects.

Also the configuration may be modified in the position of the electric power supply brushes or in the shape of the electrodes of the conveying belt, in such a manner that, in the contact start position of the sheet material 18 with the conveying belt 1, the attraction force is exerted in an area of a certain width at the front end of the sheet material. In such case, when the position of the electric power supply brushes remains unchanged, the electrodes may be modified to a form with a smaller bending angle. In any of these cases, the attraction force area to the sheet material gradually spreads toward the rear side of the sheet material and also toward both lateral ends portions. Therefore the sheet can be conveyed without the residual air remaining between the sheet material and the conveying belt and there can be obtained effects similar to those of the present embodiment.

Furthermore, in order to realize a attraction of the sheet material so as to more securely expel the air between the sheet material and the conveying belt, it is preferred that the sheet material is securely attracted directly under an ink jet head of the most upstream side in the conveying direction. For this reason, it is desirable to determine the position of the electric power supply brushes and the shape of the electrodes in such a manner that the attraction force starts to be exerted from the central portion in the front end of the sheet material in the state where the front end of the sheet material starts contact the conveying belt as shown in FIG. 7.

Figure 15:
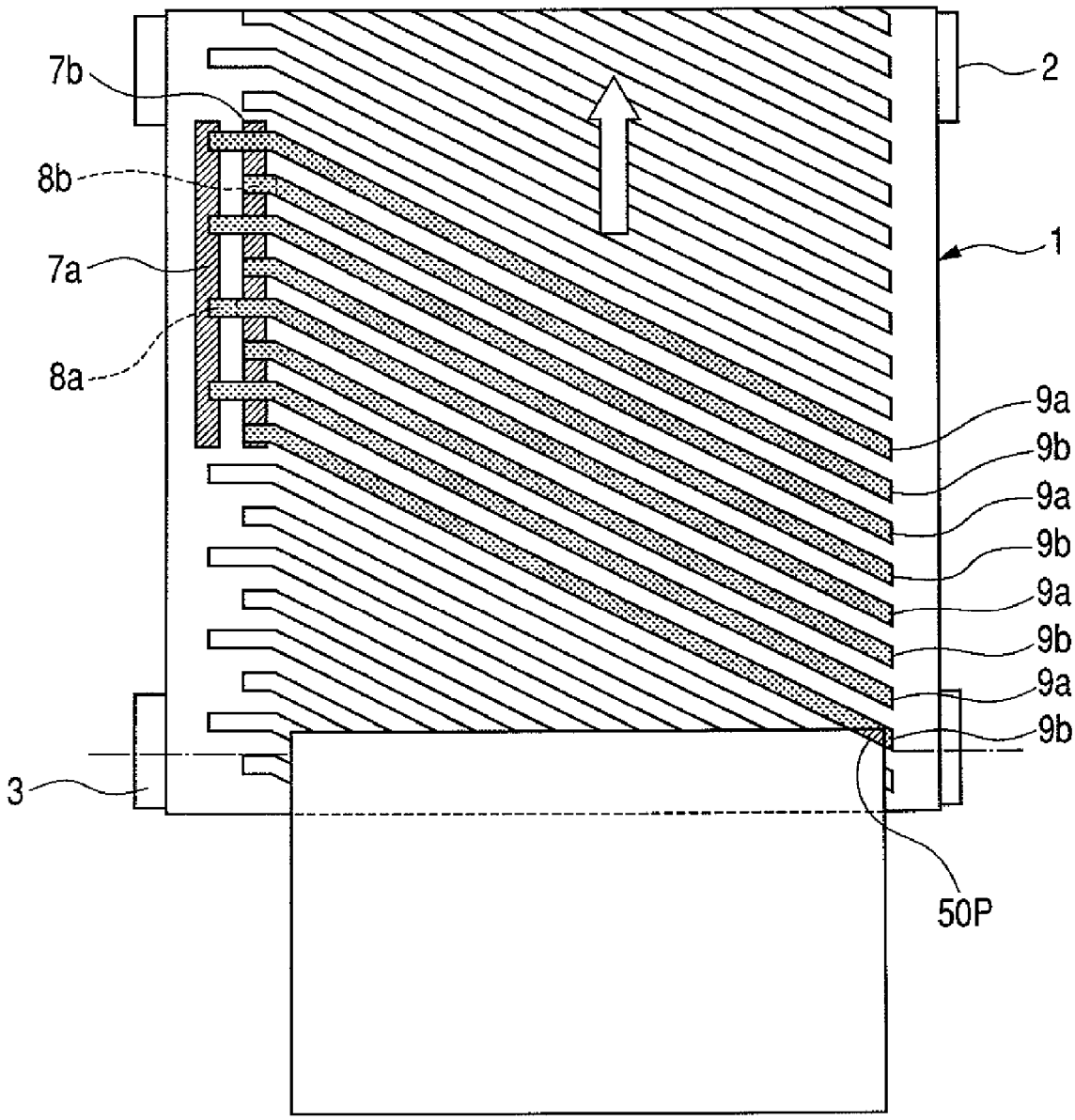
FIG. 15 is a schematic plan view showing a principal configuration of a second embodiment of the sheet material conveying apparatus of the present invention.

FIG. 15 is a schematic plan view showing a principal configuration of a second embodiment of the sheet material conveying apparatus of the present invention. As shown in FIG. 15, a first electric power supply brush 7*a* and a second electric power supply brush 7*b* are provided on one side (left-hand side in the drawing) of the conveying belt 1. A first electrode 9*a* and a second electrode 9*b* are alternately positioned, in plural units, with a predetermined gap therebetween along the conveying direction. In the present embodiment, the first electrode 9*a* and the second electrode 9*b* are positioned with a same inclining angle to the conveying direction from a lateral end of the conveying belt 1 to the other lateral end. The first electrode 9*a* is provided, at an end (at the left-hand side in the drawing) thereof, with a first electric power receiving portion 8*a* coming into contact only with the first electric power supply brush 7*a*, and the second electrode 9*b* is provided, at an end (at the left-hand side in the drawing) thereof, with a second electric power receiving portion 8*b* coming into contact only with the second electric power supply brush 7*b*. The electric power receiving portions 8*a*, 8*b* are formed by eliminating the belt substrate in such a manner that the first electrode 9*a* receives a voltage application only from the first electric power supply brush 7*a* and the second electrode 9*b* receives a voltage application only from the second electric power supply brush 7*b*.

The present embodiment is different in the above-explained points from the foregoing first embodiment, but is substantially same thereto in other aspects, and corresponding portions are represented by a same symbol. In this embodiment, a attraction force between the sheet material 18 and the conveying belt 1 is generated in an area of the first electrode 9*a* and the second electrode 9*b* in contact with the electric power supply brushes 7*a* and 7*b*. Also FIG. 15 shows a state where a conveyed sheet material 18 is slightly conveyed after an initial contact with the conveying belt 1, and the attraction force in this state is generated only in an area 50P, which, in the present embodiment, is a right-hand end portion at the front end of the sheet material 18 with respect to the conveying direction.

As the sheet material 18 is conveyed in the direction indicated by an arrow from the position shown in FIG. 15, the electrodes 9*a*, 9*b* in contact with the brushes 7*a*, 7*b* are switched in succession, but the attraction force area remains in a substantially same position on the conveying belt 1. Therefore the attraction force area to the sheet material 18 spreads in succession toward the rear side in the conveying direction and also toward the other lateral end (left-hand end in the drawing). Thus there is generated a function of expelling the air, present between the conveying belt 1 and the sheet material 18, not only toward the rear side in the conveying direction but also toward the left-hand lateral end thereby achieving a more intimate contact between the sheet material 18 and the conveying belt 1.

Also in the present embodiment, it is possible, as in the first embodiment, to modify the position of the electric power supply brushes 7*a*, 7*b* and the shape of the electrode pattern (electrodes 9*a*, 9*b*) in such a manner that the attraction force to the sheet material is generated after the sheet material is conveyed for a while from the initial contact of the sheet material 18 with the conveying belt 1. It is also possible to modify the position of the electric power supply brushes 7*a*, 7*b* and the shape of the electrode pattern in such a manner that, in the contact start position of the sheet material 18 with the conveying belt 1, the attraction force is exerted in an area, wider than the area 50P, at the front end of the sheet material.

In the present embodiment, the electric power receiving portions 8*a*, 8*b* are formed by bending end portions of the electrode pattern 9 (9*a*, 9*b*) by a relatively small angle, but, as each electrode is substantially linear in the entire shape, an operation of embedding the electrode member into the belt substrate in preparing the conveying belt can be executed easier than in the first embodiment. Also each electrode may be made completely linear, without being bent at the part of the electric power receiving portion 8*a*or 8*b*.

In the above-explained embodiment of the sheet material conveying apparatus for conveying a sheet material under attraction to a conveying belt, the attraction means for attracting the sheet material to the conveying belt is so constructed that the attraction area spreads from the front end of the sheet material toward the rear side in the conveying direction and also from a portion in the front end toward both lateral ends in the direction of width. Such configuration enables a conveying operation while expelling the air present between the sheet material and the conveying belt not only toward rear side in the conveying direction but also toward both lateral ends, thereby avoiding a floating state of the sheet material even in case of conveying a sheet material of a low gas permeability. Thus, there can provided a sheet material conveying apparatus and an image forming apparatus, capable of solving a drawback of a recording failure induced by a frictional contact between the floating part of the sheet material and the recording head or the like, and also of positioning the recording head closer to the sheet material, thereby improving the image quality of the recorded image.

Figure 16:
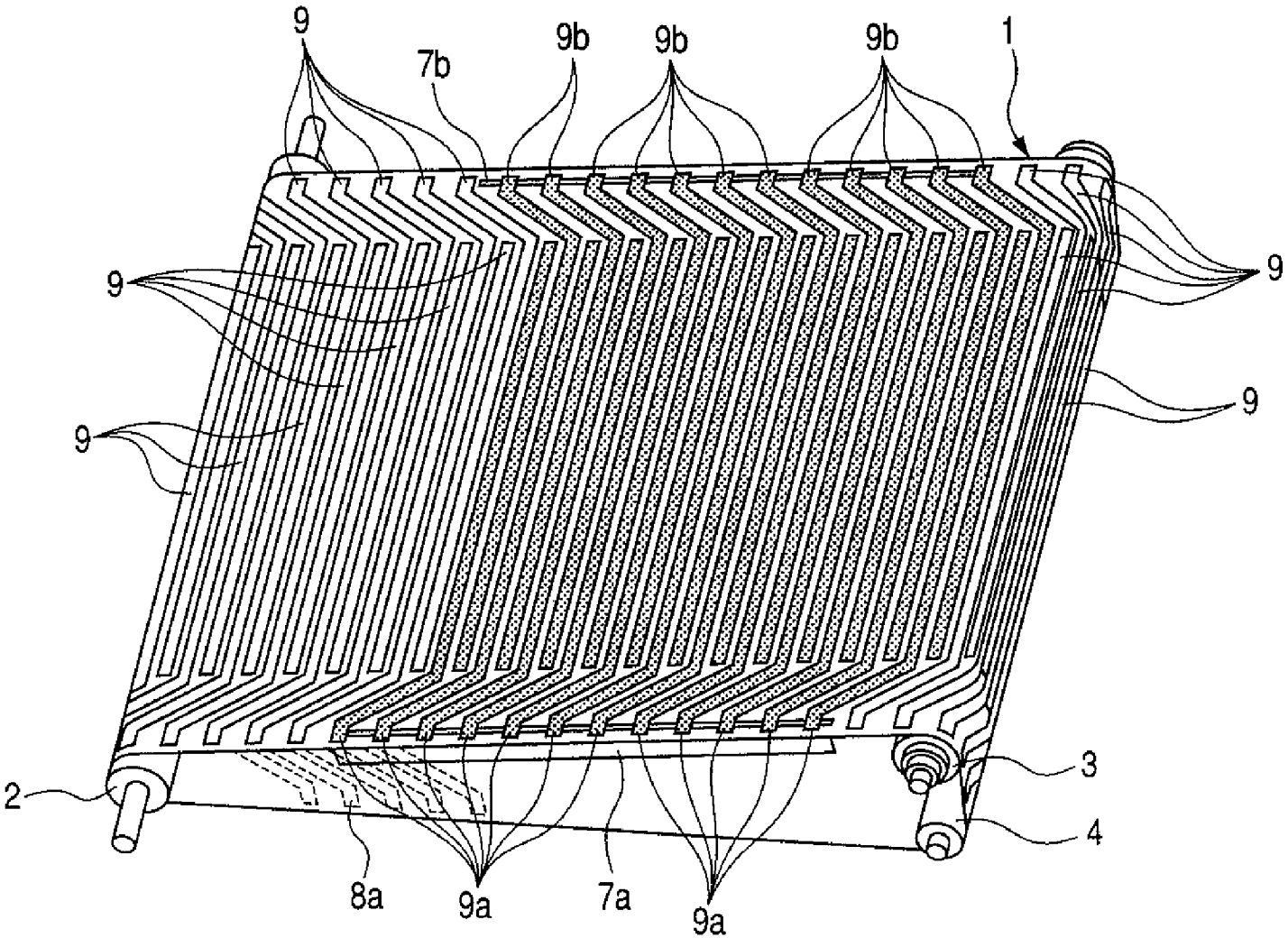
FIG. 16 is a schematic perspective view showing a belt unit in a third embodiment of the present invention.

FIG. 16 also shows an electrode pattern of the conveying belt of the present embodiment. On both lateral sides in the conveying direction, electric power receiving portions, to be contacted by the electric power supply brushes for applying voltages to the electrodes 9*a*, 9*b*, are provided in a state exposed to the rear surface of the conveying belt 1. An electric power receiving portion (first electric power receiving portion) 8*a* for the first electrode 9*a* is provided at the left lateral end, to the conveying direction, on the rear surface of the conveying belt 1, and an electric power receiving portion (second electric power receiving portion) 8*b* for the second electrode 9*b* is provided at the right lateral end, to the conveying direction, on the rear surface of the conveying belt 1.

In the present embodiment, the electric power supply brushes 7*a*, 7*b* constituting the electric power supply portion are positioned within a space inside the endless conveying belt 1 supported by the rollers 2, 3, 4, namely an internal space formed by the rear surface of endless belt. Thus the electric power supply brushes 7*a*, 7*b* can contact, within a certain longitudinal range in the conveying direction, the electric power receiving portions 8*a*, 8*b* exposed on the rear surface of the conveying belt 1. Such configuration eliminates the necessity of expanding the width of the conveying belt 1, thereby allowing to corresponding reduce the belt width.

This is based on following reasons. In a configuration in which the electric power receiving portions 8*a*, 8*b*, formed on lateral ends of the electrodes 9*a*, 9*b*, are provided contactable from the conveying surface (top surface) of the conveying belt 1, an ink erroneously dropped on the conveying belt may reach the electric power receiving portions 8*a*, 8*b*. In order to prevent such situation, the electric power receiving portions need to be placed in a position separated by a certain distance from an image forming area, thus correspondingly increasing the width of the conveying belt.

On the other hand, in the present embodiment, the electric power supply brushes 7*a*, 7*b* are positioned inside the conveying belt 1, and the electric power receiving portions 8*a*, 8*b* to be contacted by the brushes are exposed on the rear surface of the conveying belt 1. Consequently, even in case an ink is dropped on the surface of the conveying belt, it very unlikely can reach the electric power receiving portions on the rear surface of the conveying belt. Therefore the electric power receiving portions 8*a*, 8*b* need not be separated from the image forming area (recording area) and the width of the conveying belt 1 can be correspondingly reduced.

Figure 27:
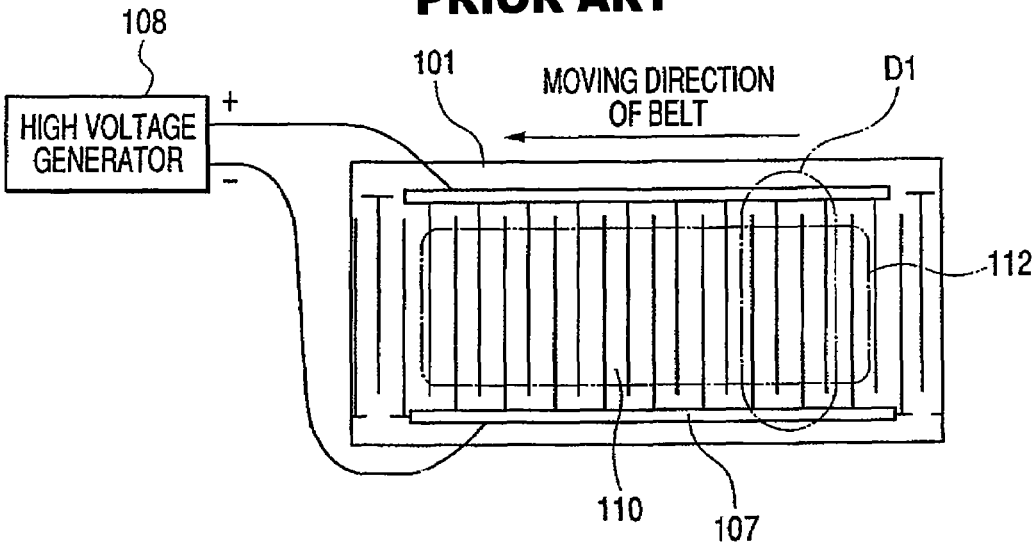
FIG. 27 PRIOR ART
FIG. 27 is a schematic plan view showing a configuration of a prior sheet material conveying apparatus of belt conveying type.
Figure 28:
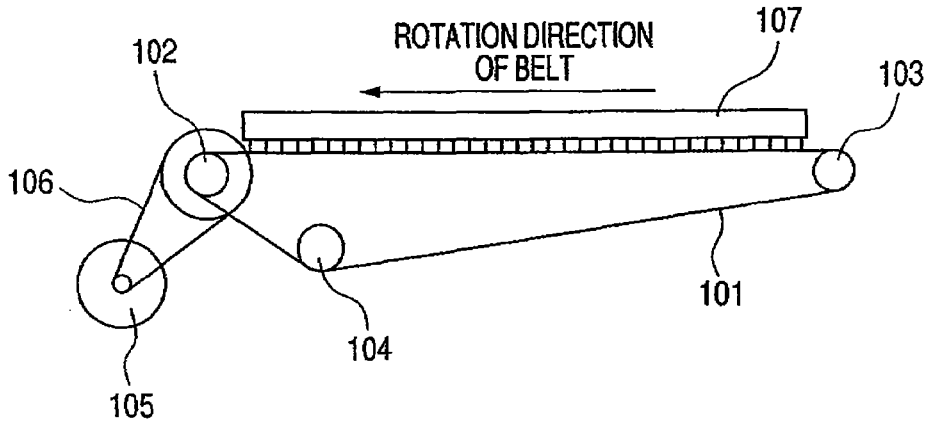
FIG. 28 PRIOR ART
FIG. 28 is a schematic lateral view of the sheet material conveying apparatus shown in FIG. 27.
Figure 29:
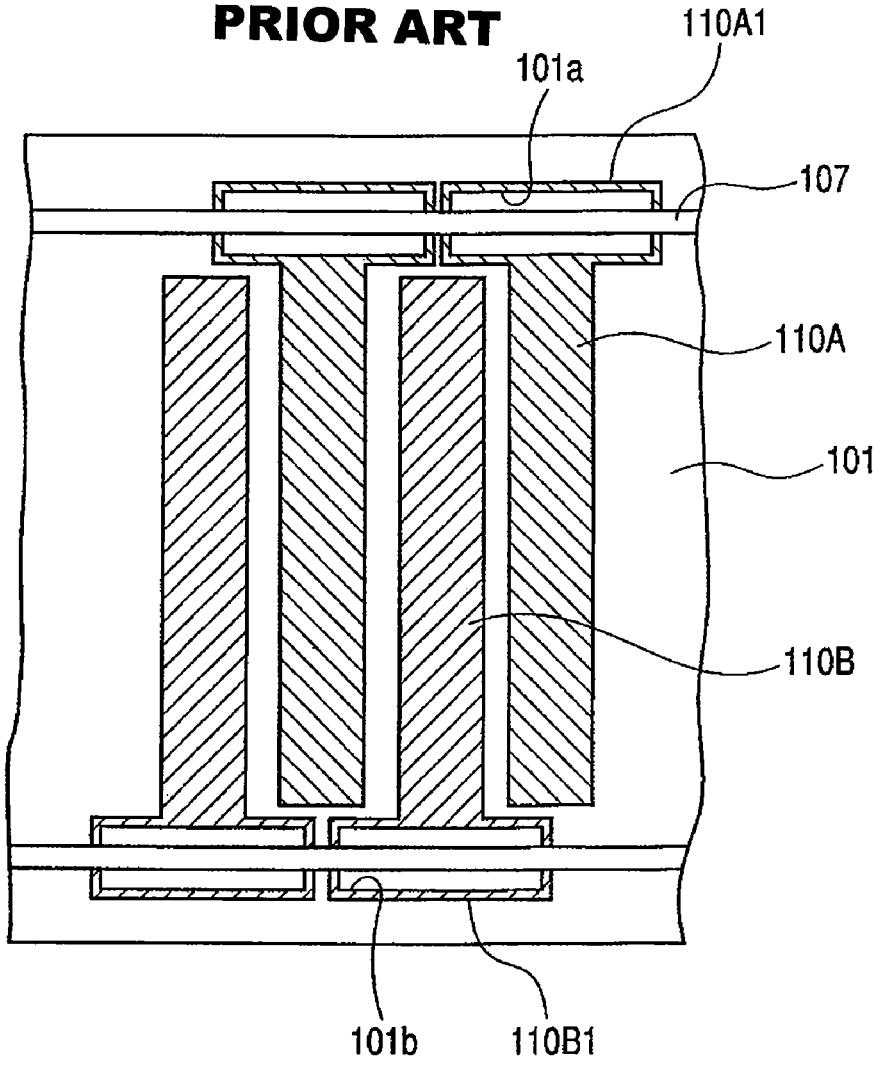
FIG. 29 PRIOR ART
FIG. 29 is a schematic magnified partial plan view of a portion D1 in FIG. 27.
Figure 30:
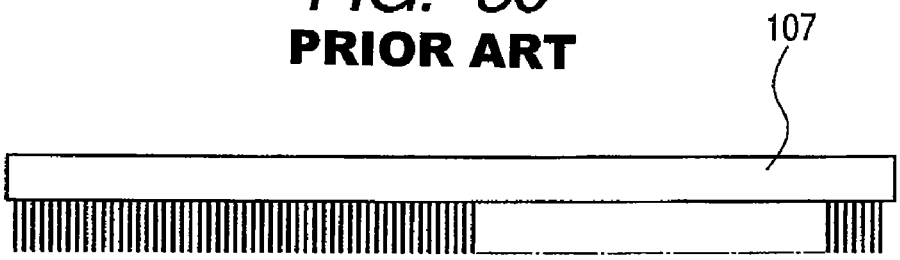
FIG. 30 PRIOR ART
FIG. 30 is a schematic lateral view of an electric power supply brush shown in FIGS. 27-29.
Figure 31:
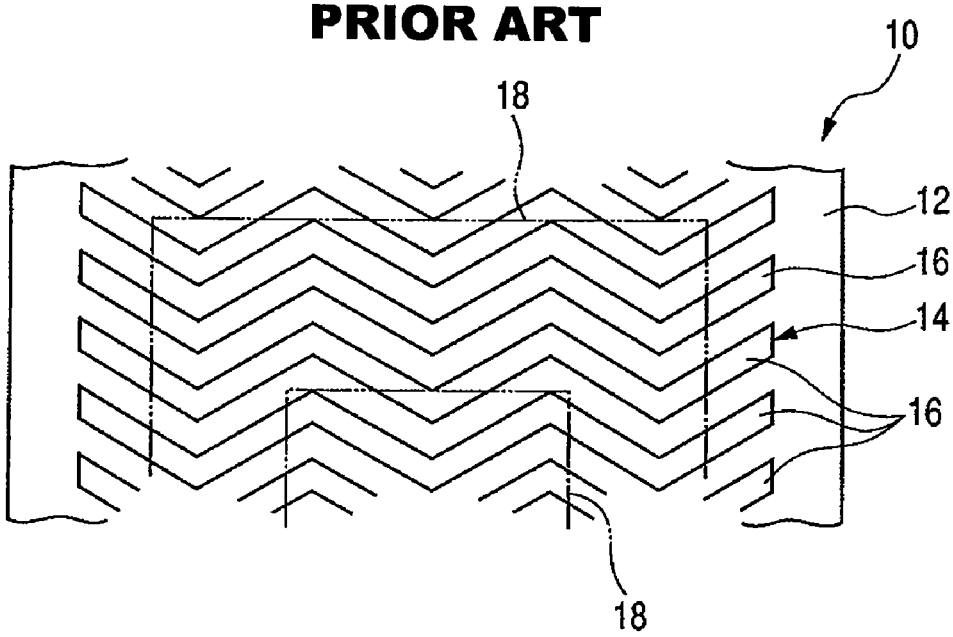
FIG. 31 PRIOR ART
FIG. 31 is a schematic view showing an example of an electrode pattern of a conveying belt of a prior sheet material conveying apparatus.
Figure 32:
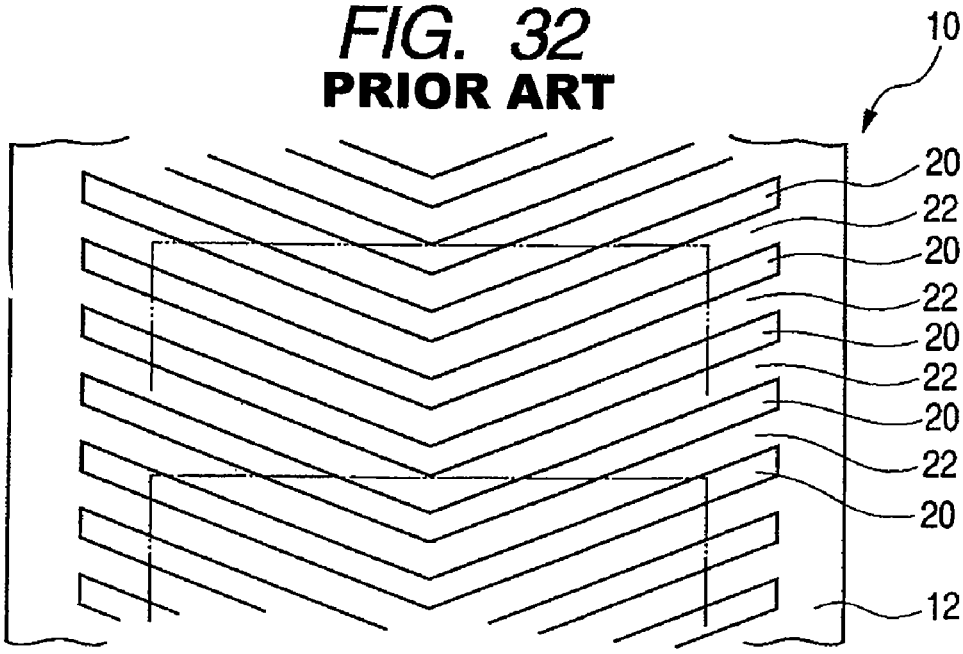
FIG. 32 PRIOR ART
FIG. 32 is a schematic view showing another example of the electrode pattern of the conveying belt of the prior sheet material conveying apparatus.

On the other hand, the electric power supply brushes, being positioned inside the conveying belt, are restricted within a range not interfering with rollers (drive roller 2, idler roller 3 and tension roller 4 in the present embodiment). Also in case of a linear electrode pattern provided in a direction perpendicular to the conveying direction of the conveying belt from the electric power receiving portions as shown in FIGS. 27 and 28, the configuration with the electric power supply brushes provided inside the conveying belt is unable to apply high voltages to the electrodes positioned around the conveying roller 103. It is therefore not possible to generate a attraction force in the vicinity of the upper part of the conveying roller 103, where the sheet material comes into first contact with the conveying belt 101.

In the present embodiment, therefore, the electrodes 9*a*, 9*b* constituting a sheet material attracting portion or a attraction area coming in contact with the sheet material are shifted, as shown in FIG. 16, toward the upstream side in the conveying direction with respect to the electric power receiving portions 8*a*, 8*b* formed on the lateral ends of the belt, thereby being positioned at the upstream side in the conveying direction. In the present embodiment, as shown in FIGS. 16 and 17 to 25, the electrode patterns 9 (9*a*, 9*b*) extend substantially linearly in a direction substantially perpendicular to the conveying direction within a range covering the width of the sheet material 18 (range larger than the width of the sheet material 18 by a predetermined width), and, at a lateral side (opposite sides for the electrode 9*a* and 9*b*), are inclined with a relatively large angle to the downstream side in the conveying direction. Thus, each of the electrodes 9*a* and 9*b* is formed by an inclining portion, inclined from a lateral end to the upstream side in the conveying direction, and a linear portion, positioned at the upstream side and extending in the direction of width. Also at a lateral end of each electrodes an electric power receiving portion 8 (8*a* or 8*b*) is exposed on the rear surface of the belt.

Such electrode pattern allows to generate a attraction force in the vicinity of the upper part of the idler roller 3, where the sheet material 18 comes into an initial contact with the conveying belt 1, even when the electric power supply brushes 7*a*, 7*b* are positioned within the internal space formed by the rear surface of the endless belt. It is thus made possible to suck the sheet material 18 on the conveying belt 1 in an earlier stage, and thus to select the position of the image forming means in a more upstream side in the conveying direction even in case of image forming means elongated in the conveying direction such as that constituted of the full-line heads 6*a*-6*f* as shown in FIG. 1, thereby achieving compactization of the apparatus.

Figure 17:
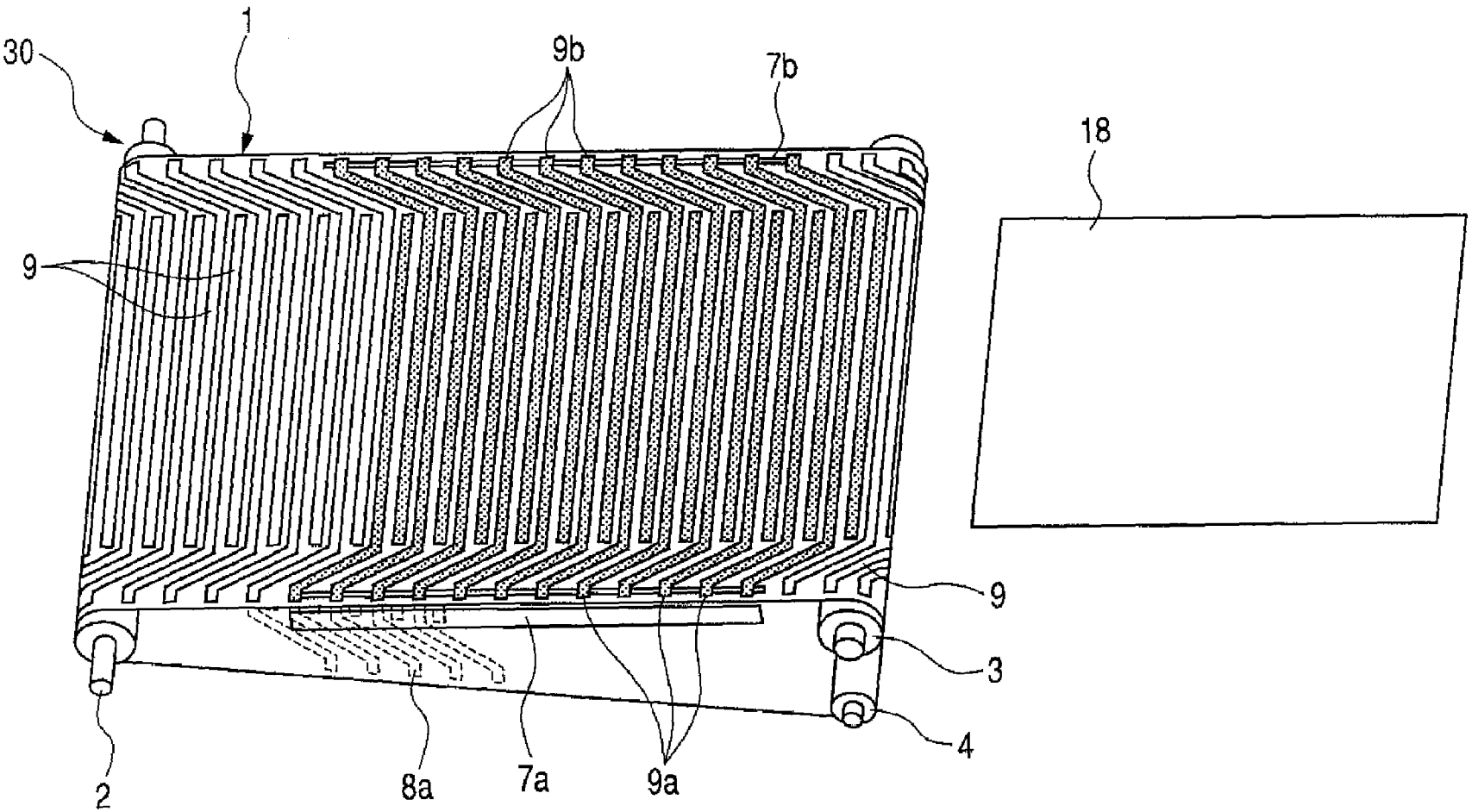
FIG. 17 is a schematic perspective view showing a state where a sheet material is conveyed to a position in front of the belt unit.
Figure 18:
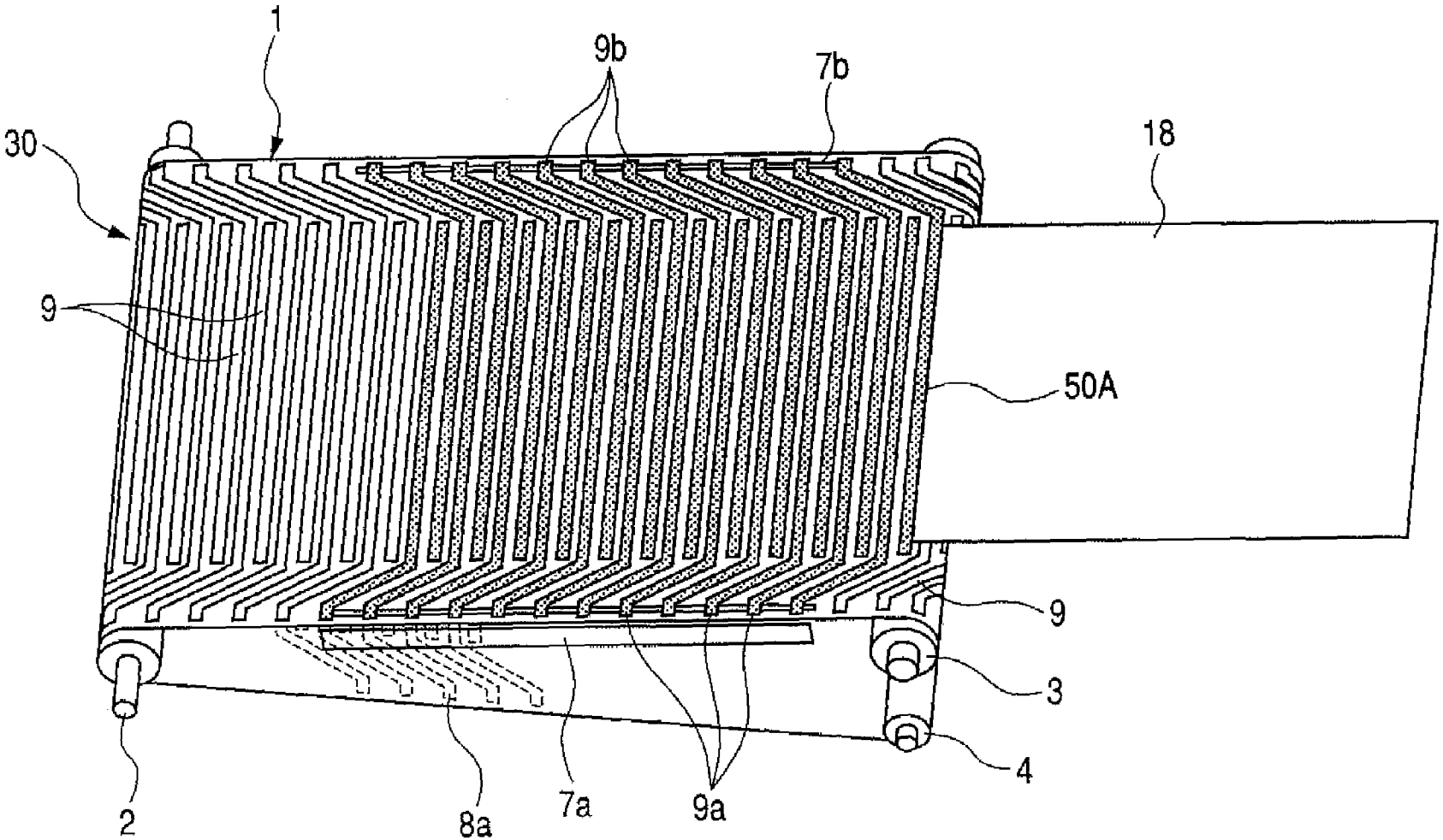
FIG. 18 is a schematic perspective view showing a state where the sheet material is conveyed further from the state shown in FIG. 17 to a position where a front end of the sheet material is in contact with the conveying belt and a attraction to the sheet material is to be started.
Figure 19:
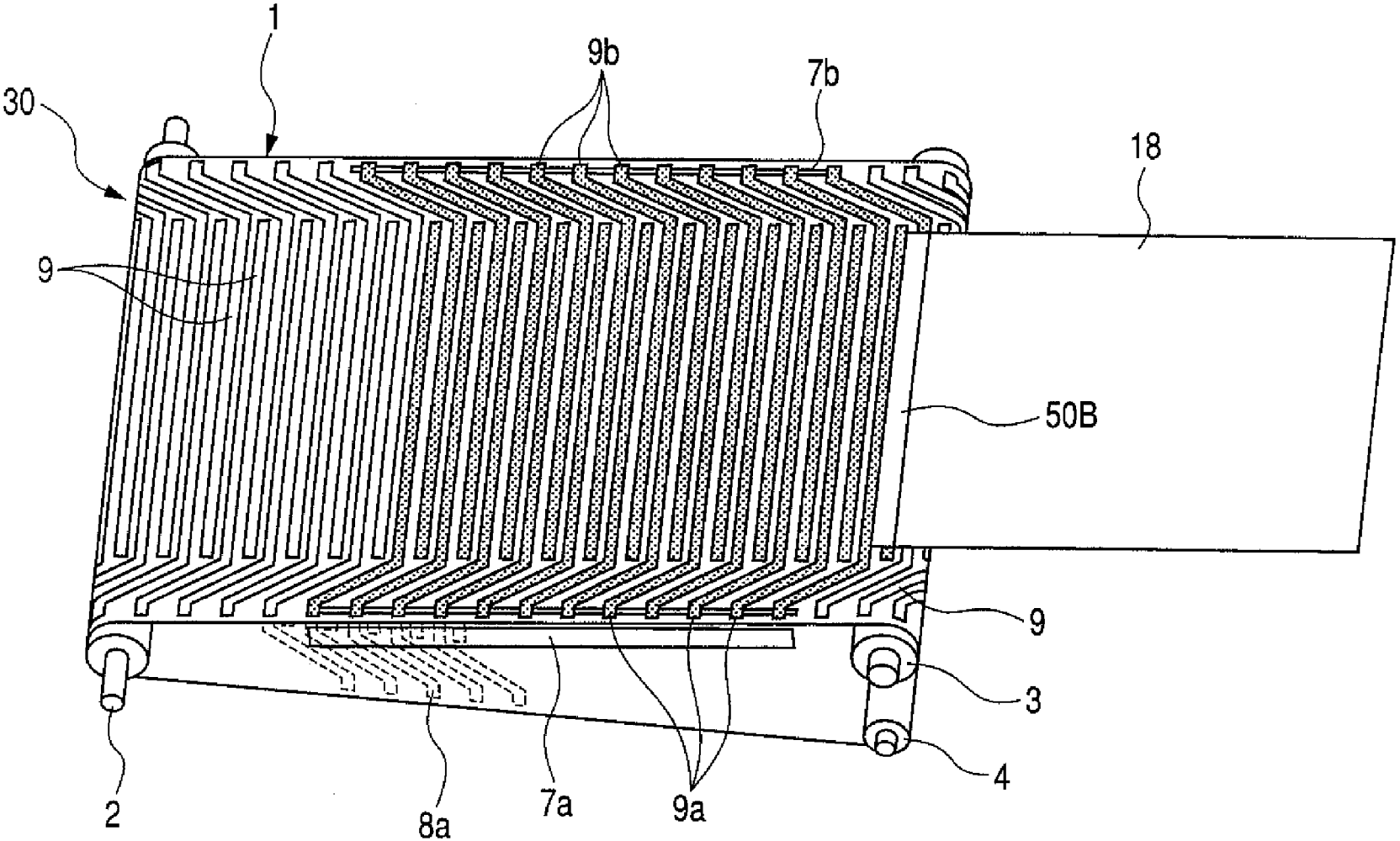
FIG. 19 is a schematic perspective view showing a state where the sheet material is conveyed further from the state shown in FIG. 18 and the conveying belt forms a attraction force area to the sheet material.
Figure 20:
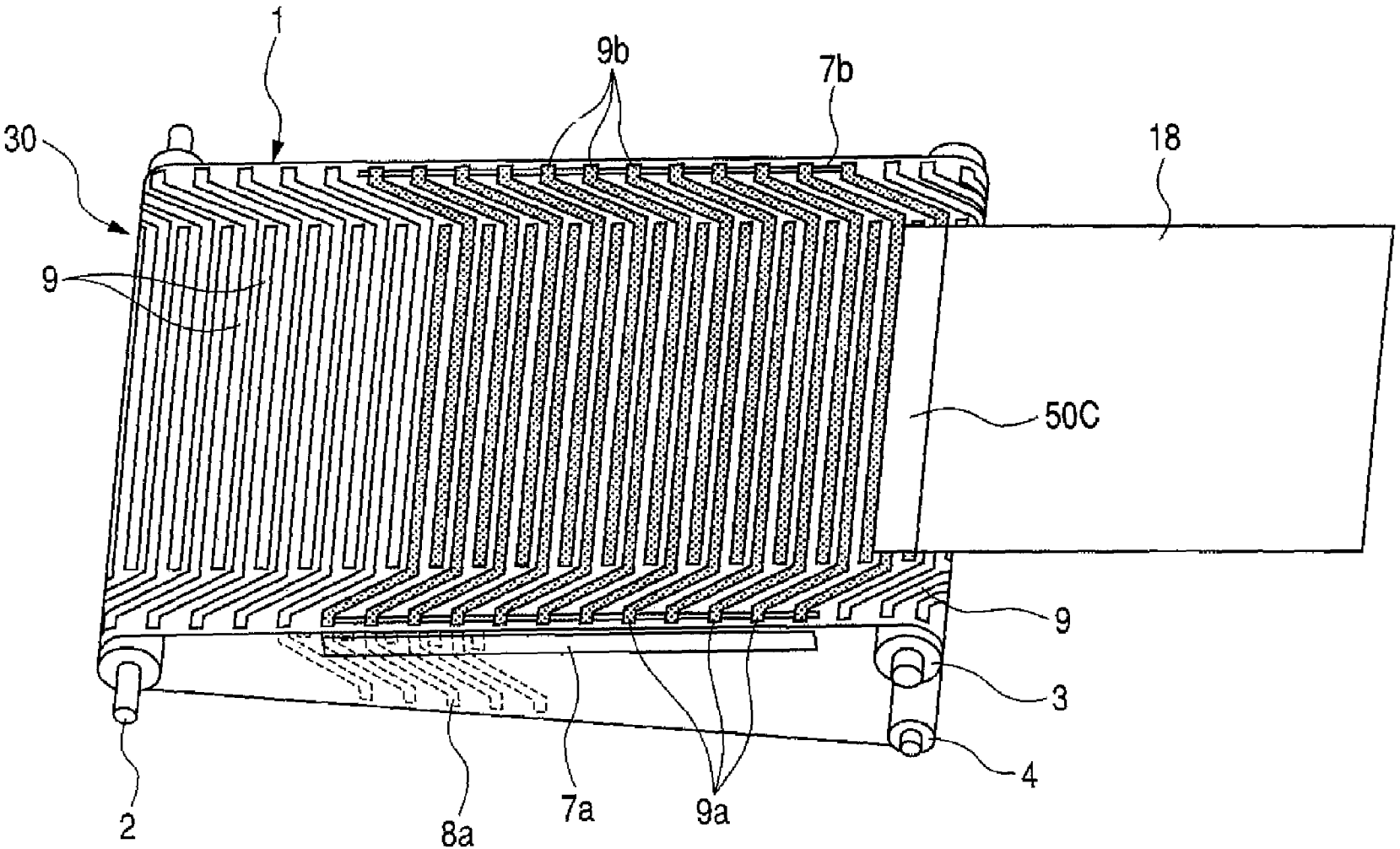
FIG. 20 is a schematic perspective view showing a state where the sheet material is conveyed further from the state shown in FIG. 19 and the attraction force area to the sheet material is somewhat widened.

FIGS. 17 to 25 are schematic perspective views showing operations when a sheet material 18 is conveyed under attraction by a belt unit 30. FIG. 17 shows a state where the sheet material is conveyed to a position in front of the belt unit, and FIG. 18 shows a state where the sheet material is conveyed further from the state shown in FIG. 17 to a position where a front end of the sheet material comes into contact with the conveying belt and a attraction of the sheet material is started. FIG. 19 shows a state where the sheet material is conveyed further from the state shown in FIG. 18 and the conveying belt forms a attraction force area to the sheet material, and FIG. 20 shows a state where the sheet material is conveyed further from the state shown in FIG. 19 and the attraction force area to the sheet material is somewhat widened.

Figure 21:
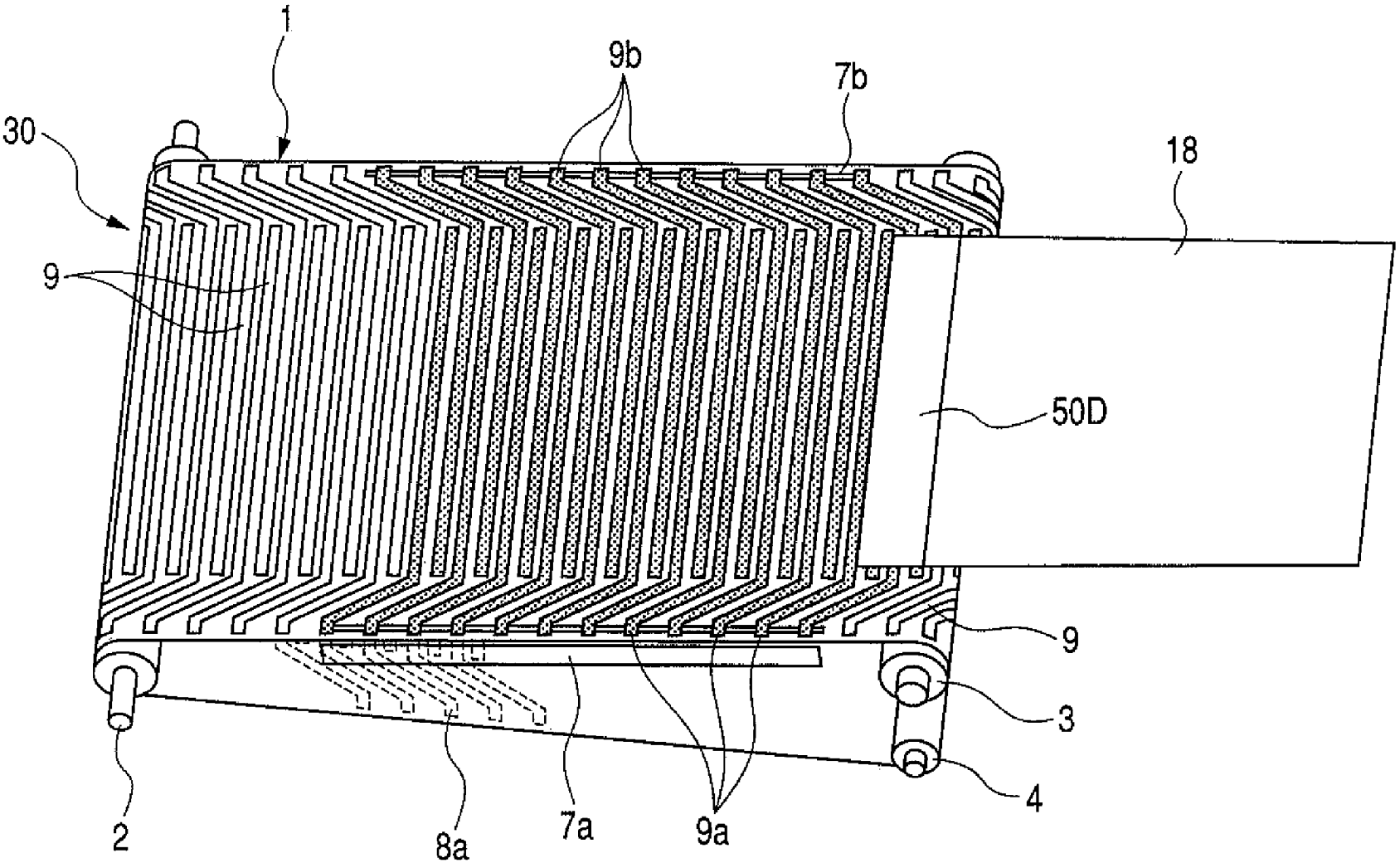
FIG. 21 is a schematic perspective view showing a state where the sheet material is conveyed further from the state shown in FIG. 20 and the attraction force area to the sheet material is further widened.
Figure 22:
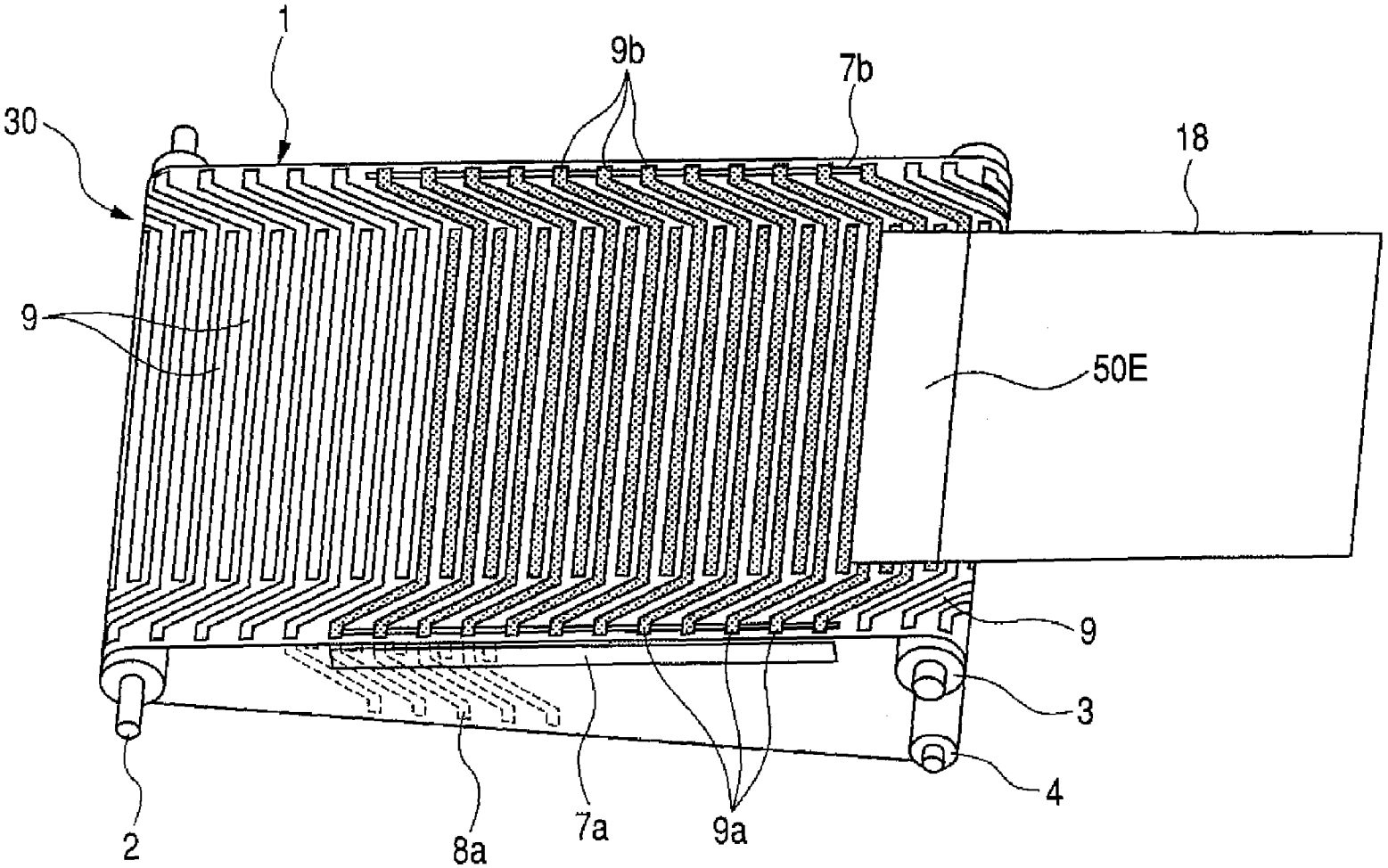
FIG. 22 is a schematic perspective view showing a state where the sheet material is conveyed further from the state shown in FIG. 21 and the attraction force area from the conveying belt to the sheet material is further widened to the rear side.
Figure 23:
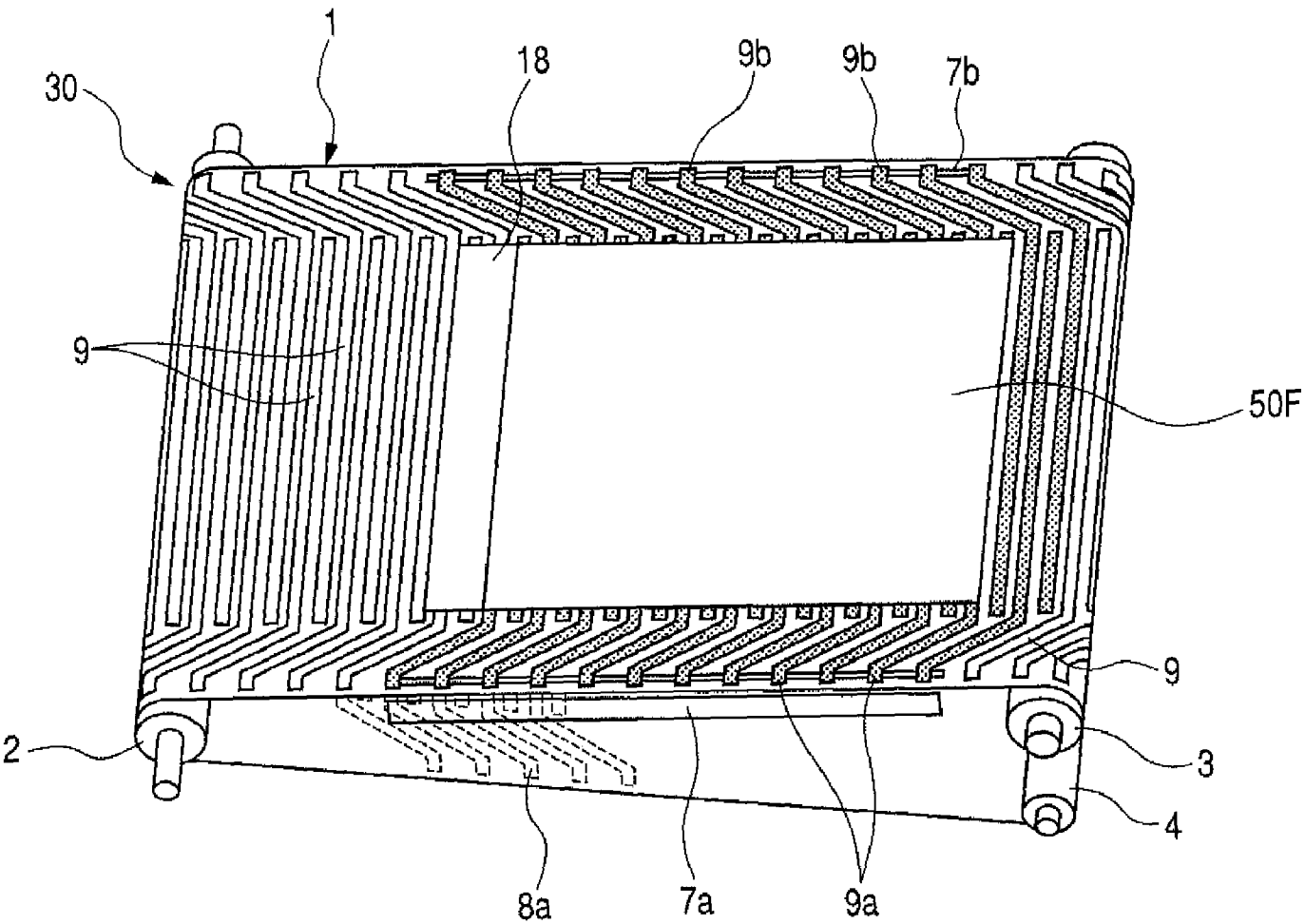
FIG. 23 is a schematic perspective view showing a state where the sheet material is conveyed further from the state shown in FIG. 22 and the attraction force area from the conveying belt to the sheet material covers the substantially entire sheet material.
Figure 24:
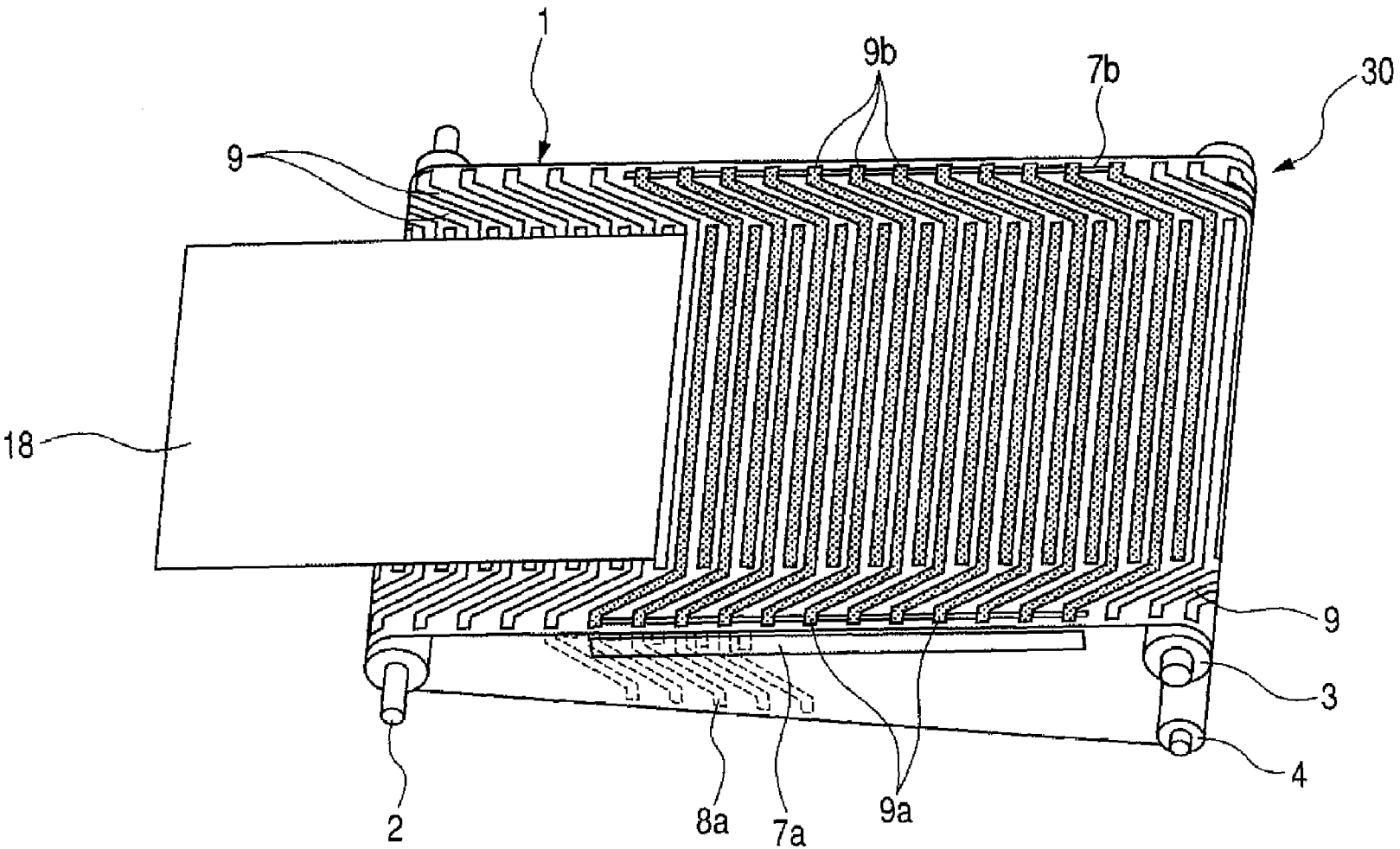
FIG. 24 is a schematic perspective view showing a state where the sheet material is conveyed further from the state shown in FIG. 23 and a rear end of the sheet material comes out of the attraction force area.
Figure 25:
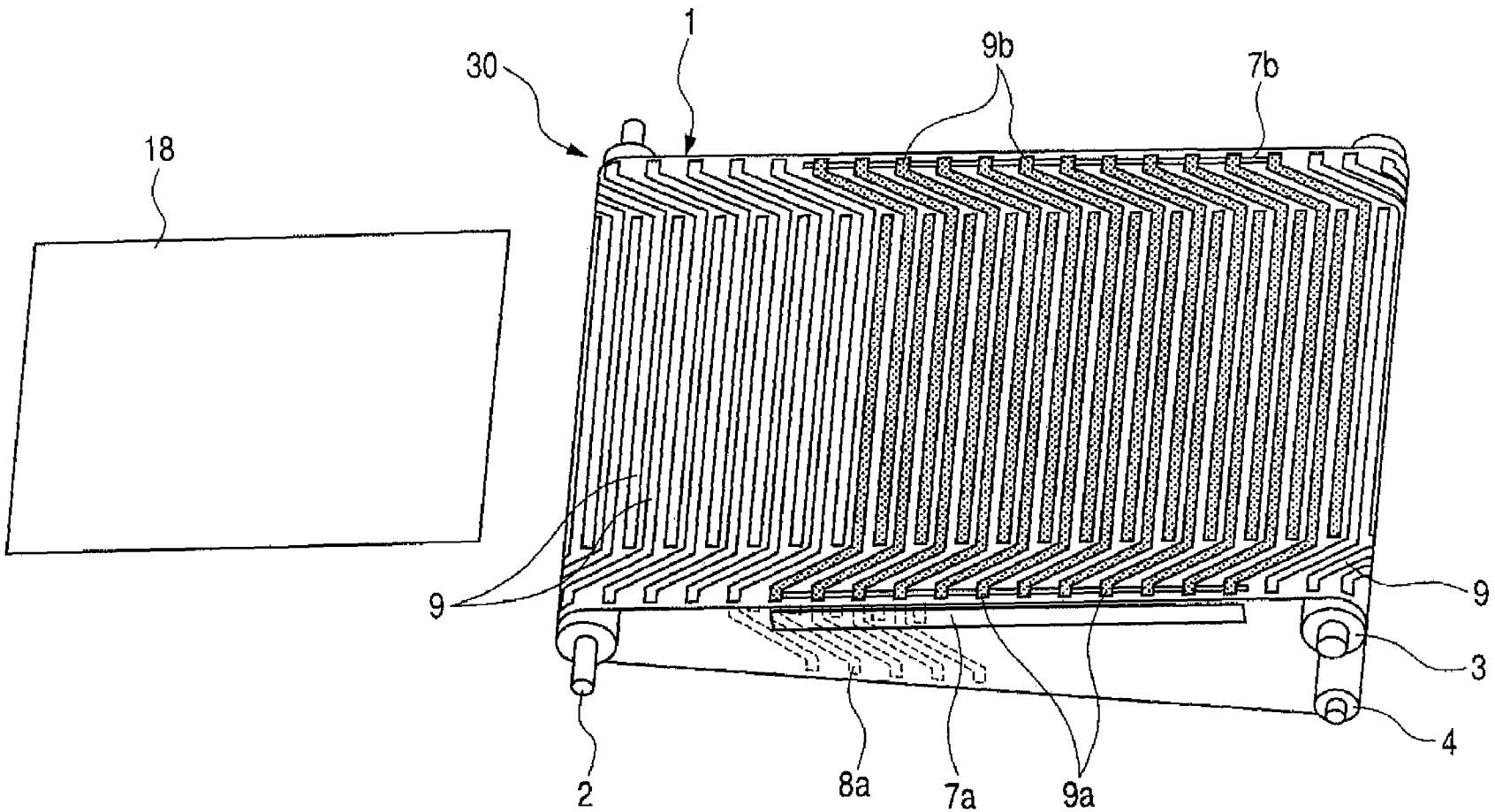
FIG. 25 is a schematic perspective view showing a state where the sheet material is conveyed further from the state shown in FIG. 24 and the sheet material is separated from the conveying belt and discharged.

FIG. 21 shows a state where the sheet material is conveyed further from the state shown in FIG. 20 and the attraction force area to the sheet material is further widened. FIG. 22 shows a state where the sheet material is conveyed further from the state shown in FIG. 21 and the attraction force area from the conveying belt to the sheet material is further widened to the rear side. FIG. 23 shows a state where the sheet material is conveyed further from the state shown in FIG. 22 and the attraction force area from the conveying belt to the sheet material covers the substantially entire sheet material. FIG. 24 shows a state where the sheet material is conveyed further from the state shown in FIG. 23 and the rear end portion of the sheet material comes out of the attraction force area, and FIG. 25 shows a state where the sheet material is conveyed further from the state shown in FIG. 24 and the sheet material is separated from the conveying belt and discharged.

Now the operations of conveying the sheet material 18 under attraction by the belt unit 30 will be explained with reference to FIGS. 17 to 25, which illustrate operation states when the A4-sized sheet material 18 is conveyed from the upstream side of the belt unit 30, then attracted by the conveying belt 1 and finally discharged to the downstream side.

In FIG. 17, the sheet material 18 such as a recording paper or a thin plastic sheet is conveyed for example by an unillustrated sheet feeding apparatus to a position in front of the belt unit 30, parallel to and with a same height as the upper surface of the conveying belt 1. In this state, the endless conveying belt 1 starts to run by a driving power transmitted from the drive roller 2 and, at the same time, the unillustrated high voltage generators start to apply-high voltages to the electrodes 9*a*, 9*b* through the electric power supply portions (electric power supply brushes) 7*a*, 7*b* and the electric power receiving portions 8*a*, 8*b*. A voltage of +1.0 kV is applied to the first electrode 9*a* in contact with the electric power supply brush 7*a* at the electric power receiving portion 8*a*, and a voltage of −1.0 kV is applied to the second electrode 9*b* in contact with the electric power supply brush 7*b* at the electric power receiving portion 8*b* of the opposite side. Thus, a attraction force for the sheet material is generated in the area of the electrodes 9*a*, 9*b* under such voltage application as shown in FIG. 17.

Then, when the sheet material is conveyed further from the state of FIG. 17 to a position where the front end of the sheet material 18 contacts the conveying belt 1 as shown in FIG. 18, an area 50A showing a attraction force to the sheet material 18 is limited to a portion, in contact with the attraction force-generating electrodes, in the front end of the sheet material 18. Thus, the structure of the belt unit 30, the shape of the electrodes 9*a*, 9*b* and the positional relationship of the electric power supply brushes 7*a*, 7*b* are so selected that, in a situation where the conveying belt 1 and the sheet material 18 are in an initial contact, the attraction force is exerted on all the front end of the sheet material.

When the sheet material 18 is further conveyed from the state shown in FIG. 18 to a position shown in FIG. 19, the attraction force from the conveying belt 1 to the sheet material is applied to an area 50B shown in FIG. 19. The area 50 in FIG. 19, in comparison with the area 50A in FIG. 18, spreads toward the rear end of the sheet material 18. As the front end portion of the sheet material 18 is completely attracted to the conveying belt 1, The image forming means 6 shown in FIG. 1 may be so positioned that the most upstream one among the full-line heads 6*a*-6*f* has an ink discharge start position in the attraction area 50B shown in FIG. 19.

When the sheet material 18 is further conveyed from a position in FIG. 19 to a position shown in FIG. 20, the attraction force from the conveying belt 1 to the sheet material is applied to an area 50C shown in FIG. 20. The area 50C in FIG. 20, in comparison with the area 50B in FIG. 19, spreads further toward the rear end of the sheet material 18. Then, when the sheet material 18 is further conveyed to a position shown in FIG. 21, the attraction force from the conveying belt 1 to the sheet material is applied to an area 50D shown in FIG. 21. The area 50D in FIG. 21, in comparison with the area 50C in FIG. 20, further spreads toward the rear end of the sheet material 18.

When the sheet material 18 is further conveyed to a position shown in FIG. 22, the attraction force from the conveying belt 1 to the sheet material is applied to an area 50E shown in FIG. 22. The area 50E in FIG. 22, in comparison with the area 50D in FIG. 21, spreads further toward the rear end of the sheet material 18. The position shown in FIG. 22 corresponds, in case the electrodes 9*a*, 9*b* are entirely linear over the width of the belt, to a position where the attraction force starts to be applied to the front end of the sheet material 18. In contrast, in the present embodiment, the attraction is started in the state shown in FIG. 18 and a considerably wide attraction area 50E is already formed in the position shown in FIG. 22.

When the sheet material 18 is further conveyed to a position shown in FIG. 23, the attraction force from the conveying belt 1 to the sheet material is applied to an area 50F shown in FIG. 23. The area 50F in FIG. 23 covers an approximately entire area of the sheet material 18, which is therefore subjected to attraction over the substantially entire area. However, in the position shown in FIG. 23, the front end portion of the sheet material 18 has passed the area of attraction force by the electrodes (attraction force area) and is not subjected to the attraction force.

In case the attraction force area is too close to the drive roller 2 at the downstream side in the conveying direction, the sheet material is subjected to a residual attraction force also when it reaches a position above the drive roller. Because of such residual attraction force, the sheet material may proceed to the lower side of the conveying belt around the drive roller 2, thereby causing an error in the sheet discharging operation. Therefore, a certain distance is preferably provided between the drive roller 2 and the attraction force area, in order to completely dissipate the attraction force from the conveying belt 1 to the sheet material 18.

In the present embodiment, even when the electric power supply brushes (electric power supply portions) 7*a*, 7*b* are positioned close to the drive roller 2 for realizing a compact apparatus, the electrodes 9*a*, 9*b* generating the attraction force under high voltage application are shifted from the electric power receiving portions 8*a*, 8*b* to the upstream side in the conveying direction, so that the above-mentioned area for dissipating the attraction force can be easily secured. When the sheet material 18 is further conveyed to a position shown in FIG. 24, the rear end portion also of the sheet material comes out of the attraction force area. Finally, as shown in FIG. 25, the sheet material 18 is separated from the conveying belt 1 and is discharged to the exterior of the main body of the apparatus.

In the embodiment explained in the foregoing, electric power receiving portions 8 (8*a*, 8*b*) are provided for each of the plural electrodes 9 (9*a*, 9*b*), and a sheet material attracting portion of each electrode is shifted to the upstream side in the conveying direction of the belt, with respect to the electric power receiving portion of such electrode. Such configuration allows to provide a sheet material conveying apparatus and an image forming apparatus capable of initiating the sheet attraction on the conveying belt earlier in the upstream side in the conveying direction, thereby enabling compactization of the main body of the apparatus.

Also the electric power supply brushes 7*a*, 7*b* constituting the electric power supply portion are positioned inside the conveying belt 1, and the electric power receiving portions 8*a*, 8*b* to be contacted by the brushes 7*a*, 7*b* for voltage application to the electrodes 9*a*, 9*b* are provided on the rear surface of the conveying belt 1. Such configuration eliminates the necessity of separating the electric power receiving portion from the image forming area, even in consideration of erroneous ink dripping onto the conveying belt 1, whereby the conveying belt 1 can be reduced in the width.

Also the electrode pattern in which the attraction area is shifted toward the upstream side in the conveying direction with respect to the electric power receiving portions 8*a*, 8*b* allows to generate the attraction force in the upstream side of the conveying direction with respect to the electric power receiving portions. Thus, even in case of positioning the electric power supply brushes 7*a*, 7*b* close to the drive roller 2, a certain distance can be secured between the drive roller and the attraction force area, to easily provide a running section for dissipating the attraction force thereby achieving a smooth sheet discharging operation and providing a sheet material conveying apparatus and an image forming apparatus of a smaller and lighter structure.

Figure 26:
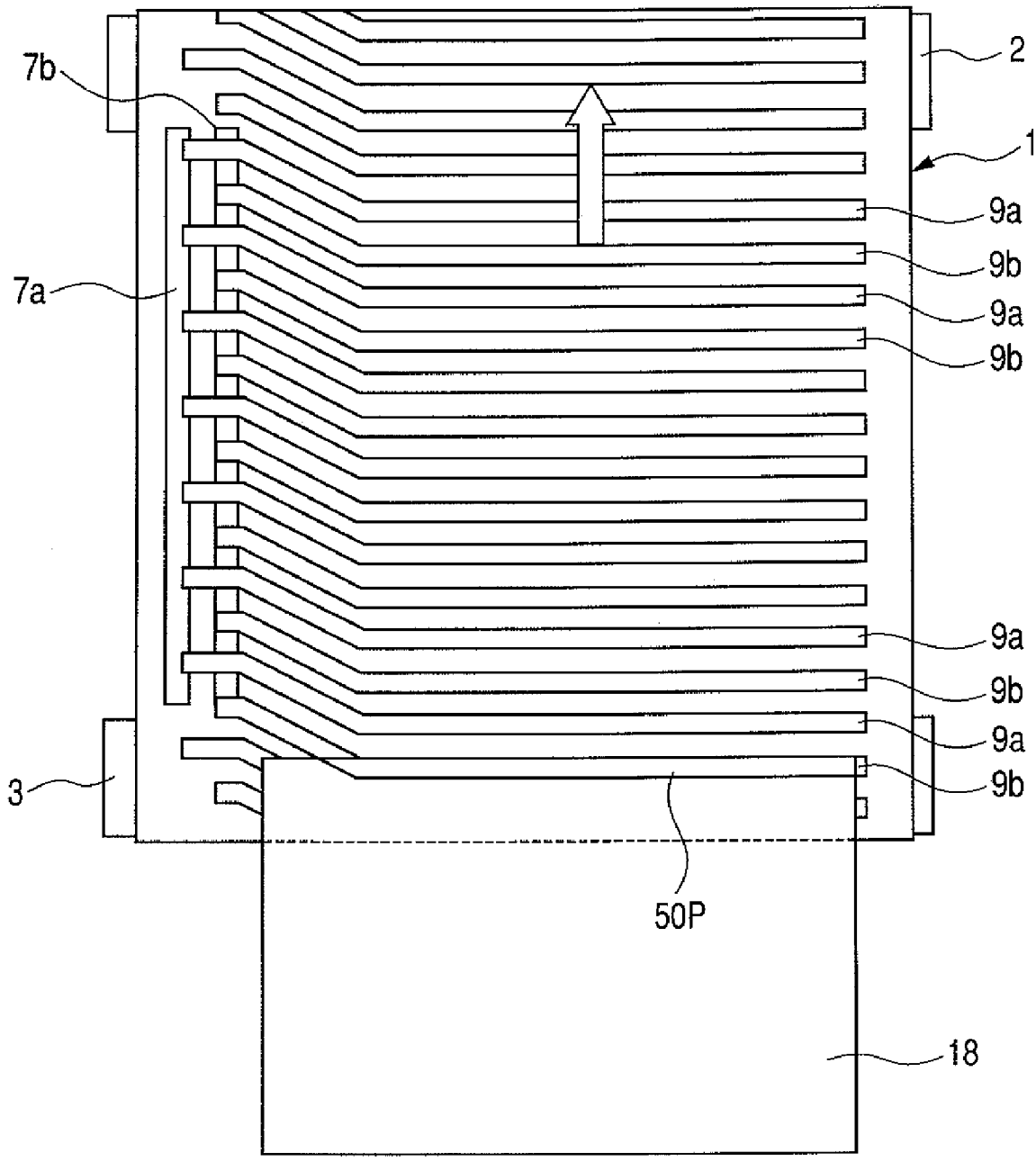
FIG. 26 is a schematic plan view showing a principal configuration of a sheet material conveying apparatus in a fourth embodiment of the present invention.

FIG. 26 is a schematic plan view showing a principal configuration of a fourth embodiment of the sheet material conveying apparatus of the present invention. As shown in FIG. 26, a first electric power supply brush 7*a* and a second electric power supply brush 7*b* are provided on one side (left-hand side in the drawing) of the conveying belt 1. A first electrode 9*a* and a second electrode 9*b* are alternately positioned, in plural units, with a predetermined gap therebetween along the conveying direction. Also in the present embodiment, the sheet material attracting portion or the attraction area where the electrodes 9*a*, 9*b* are in contact with the sheet material 18 is positioned at the upstream side in the conveying direction, with respect to the electric power receiving portions 8*a*, 8*b* formed on the lateral ends of the belt.

As shown in FIG. 26, the electrodes 9*a*, 9*b* are provided, at a lateral end of the conveying belt 1 (same lateral end for the electrodes 9*a*, 9*b* in the present embodiment), with the electric power receiving portions 8*a*, 8*b*, then shifted through an inclined portion to the upstream side in the conveying direction, and connected to the sheet material attracting portion, to be contacted with the sheet material 18 and extending substantially linearly to in a direction (direction of width of belt) substantially perpendicular to the conveying direction. Also in this embodiment, the electric power receiving portions 8*a*, 8*b* are exposed on the rear surface of the conveying belt 1. The electric power supply brushes 7*a*, 7*b* constituting the electric power supply portion are provided inside the conveying belt 1 at a lateral end thereof, and the electric power supply brush 7*a* contacts the electric power receiving portion 8*a* of the first electrode 9*a* while the electric power supply brush 7*b* contacts the electric power receiving portion 8*b* of the second electrode 9*b*.

The present embodiment is substantially same to the foregoing first embodiment except for the above-explained points, and corresponding portions are represented by a same symbol. In this embodiment, a attraction force between the sheet material 18 and the conveying belt 1 is generated in an area of the first electrode 9*a* and the second electrode 9*b* in contact with the electric power supply brushes 7*a* and 7*b*. Also FIG. 16 shows a state where a conveyed sheet material 18 is slightly conveyed after an initial contact with the conveying belt 1, and the attraction force in this state is generated only in an area 50P, whereby the attraction force is applied on the substantially entire front end portion of the sheet material 18.

As the sheet material 18 is conveyed in the direction indicated by an arrow from the position shown in FIG. 26, the electrodes 9*a*, 9*b* in contact with the brushes 7*a*, 7*b* are switched in succession, but the attraction force area remains in a substantially same position on the conveying belt 1. Therefore the attraction force area to the sheet material 18 spreads in succession toward the rear side in the conveying direction. Thus, as in the first embodiment, even when the electric power supply brushes 7*a*, 7*b* constituting the electric power supply portion are positioned inside the conveying belt 1, the attraction force can act on the sheet material 18 starting from the vicinity of the upper part of the idler roller 3 where the sheet material 18 comes into initial contact with the conveying belt 1. Also, as the rear end of the sheet material 18 comes out of the attraction force area in front of the drive roller 2 by a certain distance, the attraction force can be released (dissipated) from somewhat in front of the drive roller 2.

Therefore, the second embodiment explained above can also provide effects similar to those of the first embodiment. In the present embodiment, the electric power receiving portions 8*a*, 8*b* are formed by bending end portions of the electrode pattern 9 (9*a*, 9*b*) by a relatively small angle, but, as each electrode is substantially linear in the entire shape, an operation of embedding the electrode member into the belt substrate in preparing the conveying belt can be executed easier than in the first embodiment. Also each electrode may be made completely linear, without being bent at the part of the electric power receiving portion 8*a*or 8*b*.

The present invention has been explained by embodiments of an image recording apparatus having image forming means of linear type constituted of full-line heads, but the present invention is similarly applicable and effective also in image forming apparatuses of other types such as an image forming apparatus of serial type, utilizing image forming means executing a main scanning motion to the sheet material. Also the foregoing embodiments have been explained by an ink jet recording method, but the present invention is likewise applicable and effective in any other recording methods such as thermal transfer recording, thermal recording, laser beam irradiation recording or wire dot recording.

This application claims priority from Japanese Patent Application Nos. 2004-355861 filed on Dec. 8, 2004 and 2004-356217 filed on Dec. 9, 2004, which are hereby incorporated by reference herein.

What is claimed is:

1. A sheet material conveying apparatus for conveying a sheet material under electrostatic attraction on a conveying belt having plural electrodes arranged in a spaced manner in a conveying direction, wherein each of the plural electrodes has an electric power receiving portion, and a sheet material attracting portion of each electrode is positioned at an upstream side in the conveying direction of the belt with respect to the electric power receiving portion of the electrode, wherein the conveying belt is formed by an endless belt supported by rollers in at least two positions in upstream and downstream positions in the conveying direction, wherein the sheet material is attracted to a front side of the conveying belt and the electric power receiving portion is provided on a back side of the conveying belt, wherein the conveying apparatus comprises an electric power supply portion for supplying power to the electric power receiving portion and the electric power supply portion is provided on an inner side of the endless belt, and wherein when the sheet material attracting portion of each electrode is first in contact with the sheet material at a position opposed to an outer periphery of the upstream roller so that the sheet material attracting portion has an attraction force and when the sheet material attracting portion of the electrode is located at a position opposed to an outer periphery of the upstream roller, the electric power receiving portion of the electrode is in contact with the electric power supply power.

2. An image forming apparatus comprising image forming means for forming an image on a sheet material based on image information, and a sheet material conveying apparatus according to claim 1.

3. An image forming apparatus according to claim 2, wherein the image forming means is an ink jet recording head for executing a recording by discharging ink onto the sheet material.

4. An image forming apparatus according to claim 3, wherein an end of a attraction area for attracting the sheet material on the conveying belt, at the upstream side in the conveying direction, is positioned at a more upstream side than a most upstream ink discharge position of the image forming means in the conveying direction.

5. A sheet material conveying apparatus according to claim 1, wherein each of the plural electrodes extends substantially linearly in a direction substantially perpendicular to the conveying direction within a range covering the width of the sheet material, wherein at a lateral side of each electrode is inclined to the downstream side in the conveying direction, and wherein at a lateral end of each electrode an electric power receiving portion is exposed on the rear surface of the belt.

* * * * *